US010352042B2

(12) United States Patent
Malpesa Guerrero

(10) Patent No.: US 10,352,042 B2
(45) Date of Patent: Jul. 16, 2019

(54) CONSTRUCTIVE ASSEMBLY FOR BUILDING WALLS

(71) Applicant: Cerámica Malpesa, S.A., Villanueva de la Reina Jaén (ES)

(72) Inventor: José Malpesa Guerrero, Bailén-Jaén (ES)

(73) Assignee: Cerámica Malpesa, S.A., Villanueva de la Reina Jaén (ES)

( * ) Notice: Subject to any disclaimer, the term of this patent is extended or adjusted under 35 U.S.C. 154(b) by 0 days.

(21) Appl. No.: 15/526,966

(22) PCT Filed: Nov. 17, 2015

(86) PCT No.: PCT/EP2015/076876
§ 371 (c)(1),
(2) Date: May 15, 2017

(87) PCT Pub. No.: WO2016/079150
PCT Pub. Date: May 26, 2016

(65) Prior Publication Data

US 2017/0356184 A1 Dec. 14, 2017

(30) Foreign Application Priority Data

Nov. 17, 2014 (EP) ..... 14382454

(51) Int. Cl.
*E04B 2/02* (2006.01)
*E04B 1/12* (2006.01)
*E04B 2/86* (2006.01)

(52) U.S. Cl.
CPC ..... *E04B 2/02* (2013.01); *E04B 1/12* (2013.01); *E04B 2/8641* (2013.01); *E04B 2002/025* (2013.01); *E04B 2002/0254* (2013.01)

(58) Field of Classification Search
CPC . E04B 2/02; E04B 2/8641; E04B 1/12; E04B 2002/025; E04B 2002/0254
See application file for complete search history.

(56) References Cited

U.S. PATENT DOCUMENTS

D33,480 S * 10/1900 Meeker ..... D25/157
679,746 A * 8/1901 Grueby ..... 52/430
(Continued)

FOREIGN PATENT DOCUMENTS

JP 57-20746 5/1982
JP 04-281939 A 10/1992
(Continued)

OTHER PUBLICATIONS

"International Application No. PCT/EP2015/076876, International Search Report and Written Opinion dated Jan. 26, 2016", (Jan. 26, 2016), 9 pgs.
(Continued)

*Primary Examiner* — Rodney Mintz
(74) *Attorney, Agent, or Firm* — Schwegman Lundberg & Woessner, P.A.

(57) ABSTRACT

The present invention relates to a constructive assembly for building walls which allow forming wall coverings. Examples of coverings that can be formed with the present invention are façades, party walls and partition walls. The constructive assembly is characterized by being formed by a plurality of cables intended for being arranged under stress in the vertical position, and a plurality of blocks having coupling means for coupling them to cables such that integral joining is assured, forming the wall. Walls thus formed do not require the use of mortar or the need to be built by skilled labor, making it possible to build reformed or new exposed wall faces more easily and in a cleaner and
(Continued)

faster manner and, in the case of thin material (tiles), with the certainty that such material will not become detached.

13 Claims, 22 Drawing Sheets

(56) References Cited

U.S. PATENT DOCUMENTS 2,141,397 A 12/1938 Locke
4,631,890 A * 12/1986 Szombathelyi ..... E04B 2/8623 52/570
5,007,218 A 4/1991 Bengtson et al.
5,315,802 A * 5/1994 Hart ..... E04B 2/08 52/426
5,423,155 A * 6/1995 Bauer ..... A47F 5/0846 40/618
6,883,281 B1 * 4/2005 Chavez-Gandara .... E02D 31/02 52/223.7
8,015,772 B2 * 9/2011 Jensen ..... E04B 2/54 405/262
8,621,801 B2 * 1/2014 Bouchard ..... E04F 13/0862 52/314
8,627,625 B2 * 1/2014 Bouchard ..... E04F 13/0862 52/387
8,646,239 B2 * 2/2014 Rulon ..... E04B 2/50 52/223.7
8,966,844 B2 * 3/2015 Bouchard ..... E04F 13/0862 52/314
8,973,327 B2 * 3/2015 Bouchard ..... E04F 13/0862 52/387
9,091,055 B2 * 7/2015 Jensen ..... E04B 2/40
9,133,619 B1 * 9/2015 Roberts ..... E04C 1/00
9,238,910 B2 * 1/2016 Jensen ..... E04B 2/44
D774,212 S * 12/2016 Malpesa Guerrero ..... D25/113
D774,662 S * 12/2016 Malpesa Guerrero ..... D25/113
D776,300 S * 1/2017 Malpesa Guerrero ..... D25/115
D776,828 S * 1/2017 Malpesa Guerrero ..... D25/115
D776,829 S * 1/2017 Malpesa Guerrero ..... D25/115
D776,830 S * 1/2017 Malpesa Guerrero ..... D25/115
D776,831 S * 1/2017 Malpesa Guerrero ..... D25/115
9,714,510 B2 * 7/2017 Castonguay ..... E02D 29/02
9,725,900 B2 * 8/2017 Correia ..... E04C 1/00
2006/0101762 A1 * 5/2006 Shillingburg ..... E04B 2/46 52/503
2010/0043336 A1 * 2/2010 Jensen ..... E04B 2/44 52/604
2012/0031031 A1 * 2/2012 Rulon ..... E04B 2/50 52/503
2012/0060438 A1 * 3/2012 Jensen ..... E04B 2/44 52/438
2012/0085052 A1 * 4/2012 Bouchard ..... E04F 13/0862 52/302.1
2013/0081353 A1 * 4/2013 Jensen ..... E04B 2/40 52/742.1
2014/0298747 A1 * 10/2014 Castonguay ..... E02D 29/02 52/562
2015/0089825 A1 * 4/2015 Jones ..... E04B 2/18 33/518

FOREIGN PATENT DOCUMENTS

JP 2002-180570 A 6/2002
JP 2009-174188 A 8/2009
WO WO-2001018317 3/2001
WO WO-2016079150 5/2016

OTHER PUBLICATIONS

"Japanese Application Serial No. 2017-544995, Office Action dated Mar. 29, 2019", (w/ English Translation), 6 pgs.

* cited by examiner

CONSTRUCTIVE ASSEMBLY FOR BUILDING WALLS

PRIORITY CLAIM TO RELATED APPLICATIONS

This application is a U.S. national stage application filed under 35 U.S.C. § 371 from International Application Serial No. PCT/EP2015/076876, which was filed 17 Nov. 2015, and published as WO2016/079150 on 26 May 2016, and which claims priority to European Application No. 14382454.8, filed 17 Nov. 2014, which applications and publication are incorporated by reference as if reproduced herein and made a part hereof in their entirety, and the benefit of priority of each of which is claimed herein.

OBJECT OF THE INVENTION

The present invention relates to a constructive assembly for building walls which allow forming wall coverings. Examples of coverings that can be formed with the present invention are façades, party walls and partition walls.

The constructive assembly is characterized by being formed by a plurality of cables intended for being arranged under stress in the vertical position, and a plurality of blocks having coupling means for coupling them to the cables such that integral joining is assured, forming the wall.

Walls thus formed do not require the use of mortar or the need to be built by skilled labor, making it possible to build reformed or new exposed faces more easily and in a cleaner and faster manner and, in the case of thin material (tiles), with the certainty that such material will not become detached.

BACKGROUND OF THE INVENTION

The shortage of skilled labor in placing certain construction materials makes the overall amount for installing such works more expensive, making the placement of such materials in some circumstances unfeasible. A wall made from top-quality materials will often produce a terrible result if it is not done by professionals who obtain the right finish.

These results that do not comply with the established requirements can be merely aesthetic (for example, in exposed brick façades) or functional (as in the case of installing sound insulation or thermal insulation), with regulatory impositions that must be complied with.

Particular constructive quality problems in walls include the lack of flatness in the built surface and the presence of stains due to poor building and/or inexistent or substandard cleaning.

The high quality requirements demanded in the work not only on the supplied material level but also on the finished final element level lead to developing products that allow limiting, to the extent possible, poor practices that can occur in installation, such that the smallest number of variables possible is left for the installer to decide.

Awareness of environmental pollution, higher demands for comfort, economic studies conducted and other factors have resulted in an increase in regulatory demands as regards sound and thermal insulation in construction. This has caused a thorough revision in constructive systems used up until now.

The present invention is particularly useful in reforming homes with rather thin parts (tiles) because it enables placement ease and reasonableness, and most importantly it eliminates the risk of parts peeling off and detaching.

DESCRIPTION OF THE INVENTION

The present invention solves the problems identified above by means of using a constructive assembly which is configured to not require the use of mortar and which, as it is very simple to build, gives rise to a defect-free wall with a very high quality finish.

The terms horizontal and vertical will be used throughout the description, these terms being, in the context of the invention, absolute and non-relative terms because the term vertical must be interpreted as being oriented or distributed according to the direction of gravity (Z) and horizontal must be interpreted as being the direction perpendicular to the vertical.

The constructive assembly for building walls according to the invention allows generating or covering a surface extending between a lower bearing member and an upper bearing member located above it. The lower bearing member is the support for the wall because it receives the wall's weight. A typical embodiment of the invention consists of a wall extending on a lower bearing member formed by the floor reaching the upper bearing member formed by the ceiling. Both the floor and the ceiling give rise to horizontal planes between which the wall is located.

The constructive assembly comprises:

- a plurality of sections of cable with fixing means at the ends thereof adapted to be fixed tautly between the lower bearing member and the upper bearing member, distributed according to a directrix path in the lower bearing member (P) and the upper bearing member (T).
- Each of the sections of cable with fixing means at the ends thereof is intended for being fixed tautly between the lower bearing member and the upper bearing member. In the operative position, when the wall is in the process of being built and once it is built, the sections of cable are arranged according to a vertical direction. Tautness is obtained by the fixing means located at the ends thereof, one end being fixed to the lower bearing member and the other end being fixed to the upper bearing member.
- The vertical projection of the upper bearing member does not necessarily have to coincide with the lower bearing member, as long as it is above the latter and allows the fixing means for fixing the upper ends of the sections of cable to be located in such a position that it allows obtaining the tautness and vertical orientation of said sections of cable. This is the case in which the lower bearing member is formed by a horizontal floor, for example, on which the wall is erected, and the upper bearing member is a cantilevered element on the edge of which the upper ends of the cables are fixed such that said cables are vertical.
- The sections of cable are distributed according to a directrix path F. This directrix path is the same in the lower bearing member and in the upper bearing member. The directrix path is usually a straight line giving way to planar walls. In these cases, the directrix path coincides with the intersection between a plane parallel to the generated wall and the horizontal support plane located on the lower bearing member. This same directrix is the path along which the upper ends of the sections of cable are distributed in the fixing thereof to the upper bearing member.

This path can be curved and will give rise to a surface formed by the wall that is also curved. The surface of the wall once it is built will be a ruled surface with parallel upper and lower directrix paths ⌈ and with vertical straight generatrices.

It is also possible to carry out the invention with upper and lower bearing members in sections. One embodiment in which the upper and lower bearing members are distributed in sections is that wall located on a floor in the form of steps or planes at different heights, a ceiling in the form of steps or planes at different heights, or one in which both the floor and ceiling are formed by stepped planes located at different heights.

According to one embodiment of the invention, the sections of cable with fixing means at the ends thereof are partial sections of a single cable forming a zigzag configuration. One end of the cable is fixed to either the lower bearing member or upper bearing member and extends vertically to the opposite bearing member where there is arranged a pulley or tension element that allows changing the direction of the cable. It extends from this element for changing the direction to the next one horizontally, and from there it extends vertically giving rise to the second vertical section of cable. This zigzag configuration alternates vertical sections of cable extending between the lower bearing member and the upper bearing member, and horizontal sections of cable connecting a vertically oriented section of cable and the next one. The final end of the cable is the one fixed to the upper or lower bearing member assuring the tension of all the intermediate sections of cable. The tension generated by fixing the two ends of cable is transmitted to the remaining intermediate sections of cable as a result of the intermediate means for changing the direction.

According to one embodiment, the fixing means or the means for changing the direction securing the position of the ends of the vertical sections of cable are one-piece components. This embodiment has the advantage that it is not necessary to measure and position each of the fixing means on site, but that by positioning one-piece components both above and below the fixing means are properly distributed along the directrix path.

According to another embodiment, this one-piece component has a specific length such that walls of greater horizontal length make use of more than one one-piece component in both the lower bearing member and upper bearing member.

a plurality of building blocks having an essentially prismatic body where each building block comprises at least:

- a first support base configured for resting on the lower bearing member or on at least another building block,
- a second base arranged on the face opposite the first base configured for supporting at least another building block,
- an exposed surface extending between the first base and second base,
- an anchoring surface extending between the first base and second base arranged on the face opposite the exposed surface, wherein the anchoring surface of the building blocks comprise anchoring means for the anchoring thereof to sections of cables for stabilizing the wall.

Once the sections of cable are fixed and distributed along the directrix curve, wall construction progresses by placing the building blocks having a prismatic body in rows from bottom to top. The rows follow the path imposed by the directrix path.

Each of the building blocks has two bases, the first lower support base resting its weight either on the lower bearing member if it is the first row or on the row of building blocks of the lower row if it is not the first row. The upper base is the base which is in turn arranged to act as a support for the row located immediately thereabove. The support can be direct by supporting a building block on lower building blocks, or it can be indirect by means of parts generating a gap or distance between building blocks. Examples of intermediate parts which generate a gap and can have elements with additional functions will be described in the detailed description of the invention.

The building block also has an exposed face extending between the first base and second base. This face will usually be vertical and generates the exposed surface of the wall that is built.

Opposite this face is the anchoring surface. This anchoring surface has anchoring means adapted for anchoring sections of cables to stabilize the construction. In other words, the building blocks are not simply supported, distributed in rows, but rather the non-exposed face is anchored to the cables.

The distribution of the sections of cable must correspond with the position of the anchoring means of the building blocks such that when the building blocks are placed in rows, each of the anchoring means of these building blocks coincide with a section of cable according to the vertical projection.

In the context of the invention, the anchoring which has been obtained is of particular interest out of the different anchoring means with a cable due to the shape of the anchoring surface of the building block.

Before defining this particular way of anchoring, two directions which will be used throughout the description are defined.

The horizontal direction X is defined as the direction tangent to the directrix path ⌈. If the directrix path ⌈ is straight, the wall that is built will be planar. In this case, the horizontal direction X is the horizontal straight line resulting from the intersection between the vertical plane of the wall that is built and the horizontal plane.

The transverse direction Y is defined as the horizontal direction that is perpendicular to both the direction of gravity (Z) and the horizontal direction X. In the particular case of a planar wall this direction is the direction perpendicular to said wall.

Having defined these directions, these are the directions that will be taken as a reference on a building block considering that said building block is oriented according to its operative position in the wall. In other words, although the building block is an independent part, the vertical direction will be taken to be the direction in which the first base and second base are spaced from one another, direction X will be taken to be the direction along which the building block is oriented to be distributed in rows, and the transverse direction Y will be taken to be the direction giving rise to the spacing between the exposed face and the face where the anchoring means are located.

Also by applying these orientation references to the block as if it were in the operative mode on the wall, the horizontal direction X and transverse direction Y are the directions defining the support plane for the first base and second base.

After having established these references on the building block, the anchoring means of the building block according to a preferred example of the invention is by means of a recess penetrating the anchoring surface adapted for receiving at least one of the sections of cable.

The recess is such that in the plan projection on a plane parallel to the plane formed by the horizontal direction X and the transverse direction Y, this recess additionally shows a protuberance projecting in the horizontal direction X, this protuberance being configured for retaining at least one section of cable according to direction Y. The section of cable is housed in this recess.

The manner of obtaining this recess with the retaining protuberance is not unique. Examples of configurations of recesses with a protuberance are the dovetails. Dovetail is a recess having two protuberances oriented opposite one another according to the horizontal direction X; that is, facing to one another.

The term "half-dovetail" will also be used. In the context of the invention, half-dovetail will be understood as that recess in which there is only one protuberance oriented in the recess according to direction X. Dovetail can be interpreted to mean two half-dovetails forming a single recess and with the protuberances of both half-dovetails facing one another.

When one and the same building block has two anchoring means with protuberances oriented opposite one another either in the same recess or in different recesses, the two sections of cable intended for entering and being anchored with a block must be forced, moving them according to direction X. The movement is one that brings them closer. This movement bringing them closer is possible, even if the sections of cable are under stress, especially when building the wall as a result of part of the length of the sections of cable still being free. As the height of the wall progresses, the free sections of cable are shorter and shorter, making it harder to move them in direction X or "clamping them". According to one embodiment, the use of blocks in which recesses with protuberance have said protuberances oriented in a single direction following transverse direction Y is suitable for the final rows. This configuration allows placing the building block with two movements, a first movement for insertion in transverse direction Y, making the sections of cable enter the recesses, and a second lateral movement according to direction X so that the protuberance prevents the building block from coming out according to direction Y.

Building blocks configured as tiles are of particular interest.

A set of drawings will be used to describe embodiments of the invention.

DESCRIPTION OF THE DRAWINGS

These and other features and advantages of the invention will be better understood based on the following detailed description of a preferred embodiment, given solely by way of illustrative and non-limiting example in reference to the attached drawings.

FIG. 8B shows a sequence for insertion of the sections of cable for the fixing thereof.

FIG. 9B shows two different perspective views of the configuration of a tile-type building block having a vertical configuration or a configuration narrow in width.

FIG. 11A shows the same sequence but with the area of two of the cables enlarged.

FIG. 11B shows the same sequence but with the area of two of the cables enlarged.

DETAILED DESCRIPTION OF THE INVENTION

According to the first inventive aspect, the present invention is a constructive assembly for building walls where the wall that is built can be a wall giving rise to a constructive spacing element or giving rise to an element for covering another wall, for example for obtaining a finish in a specific space.

Figure 1:
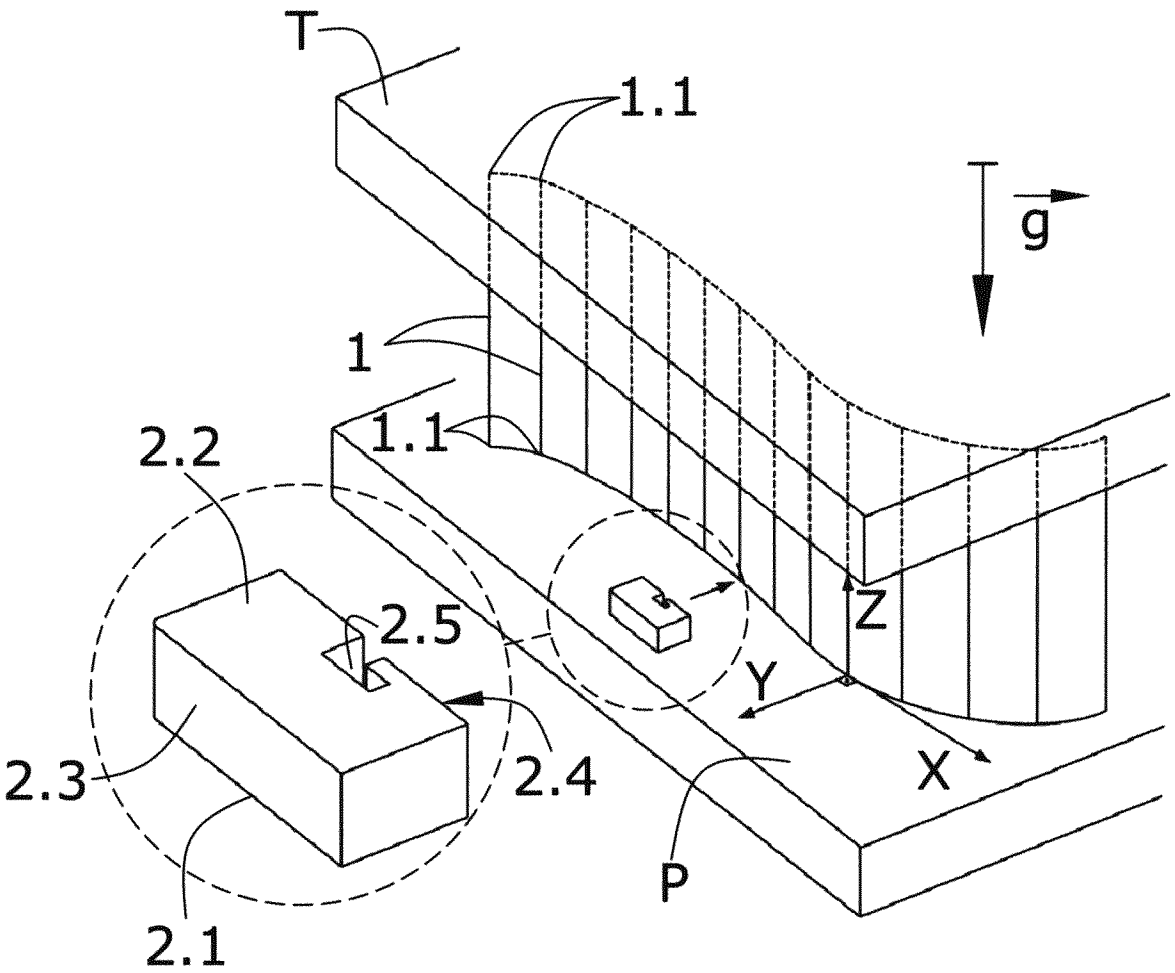
FIG. 1 This figure schematically shows the most relevant elements of the invention that allow securing the building blocks as well as a schematic depiction of a building block for building a wall.

FIG. 1 schematically shows a lower bearing member (P) configured as a base, for example a section of floor. An upper bearing member (T) configured as an upper base, for example a section of ceiling, is also schematically shown in the upper part. A plurality of sections of cable (1) under stress extend between the lower bearing member (P) and the upper bearing member (T) as a result of fixing means (1.1) arranged at each of the ends of the sections of cable (1) which are fixed to the lower bearing member (P) and to the upper bearing member (T), respectively.

The upper and lower fixing means (1.1) corresponding to one and the same section of cable (1) coincide according to the vertical projection Z, where said vertical direction Z is defined by the direction of the force of gravity $\vec{g}$. Therefore, the sections of cable (1) are also oriented vertically.

The sections of cable (1) are distributed along a directrix path (⌈) which is reproduced both on the lower bearing member (P) and on the lower surface of the upper bearing member (T).

Once the building blocks (2) are installed in the sections of cable (1) shown in this FIG. 1, a wall following the configuration imposed by the directrix path (⌈), in this case according to a curve, will be obtained.

Figure 2A:
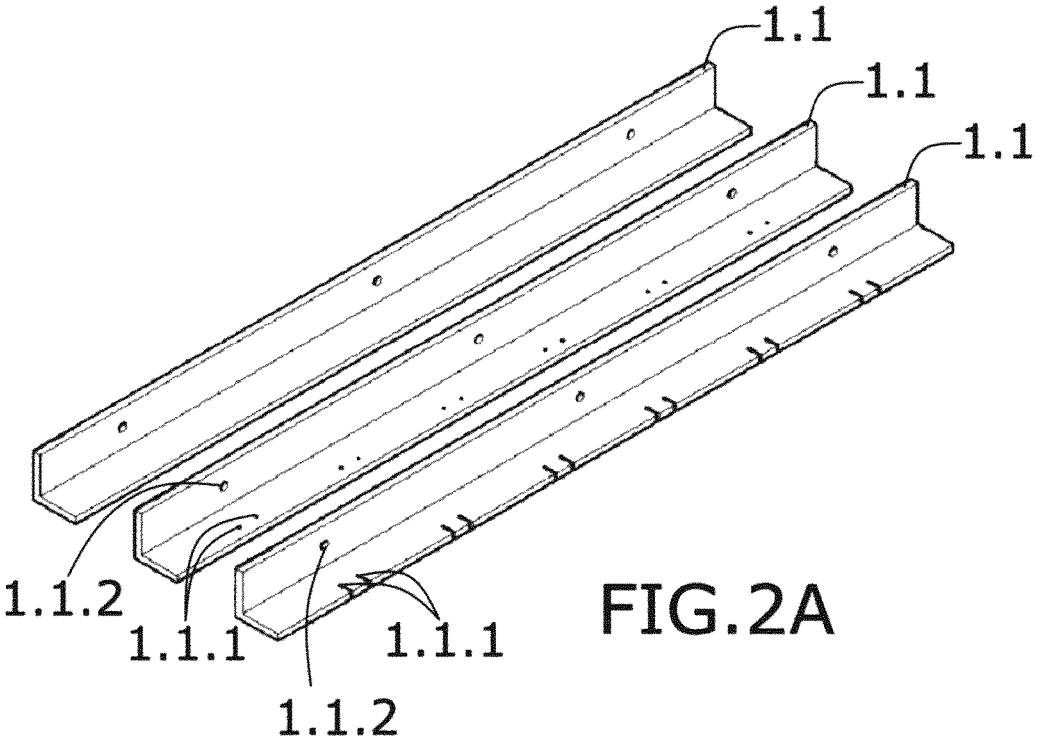
FIG. 2A, 2B These figures show embodiments of anchoring parts for anchoring the ends of sections of cable giving rise to a pre-established distribution along the directrix path r, in this case straight.

In one embodiment, the operator responsible for fixing each of the sections of cable (1) can perform the measurement and positioning of the fixing means (1.1) for fixing the sections of cable (1) one by one. According to another embodiment, the use of a part which has more than one fixing means (1.1) allows arranging a plurality of properly positioned fixing means. FIG. 2A shows three L-profiles which in turn have perforations as fixing means (1.1.2) for fixing thereof to a wall to be covered with a wall according to one embodiment of the invention, and perforations or slots (1.1.1) for the passage of the ends of the sections of cable (1) which allow fixing the ends thereof. The position of the perforations or slots (1.1.1) determines the correct spacing and spatial distribution for the sections of cable (1).

This same FIG. 1 schematically shows a building block (2) comprising at least:

- a first support base (2.1) configured for resting on the lower bearing member (P) or on at least another building block (2) and located in the lower non-exposed part;
- a second base (2.2) arranged on the face opposite the first base (2.1) configured for supporting at least another building block (2) and positioned in the upper part according to the orientation of the drawing;
- an exposed surface (2.3) extending between the first base (2.1) and second base (2.2); and
- an anchoring surface (2.4) extending between the first base (2.1) and second base (2.2) arranged on the face opposite the exposed surface (2.3).

The anchoring means (2.5) are located on the anchoring surface (2.4). The anchoring means (2.5) in the building block (2) shown in FIG. 1 are configured as a recess which in plan view shows an L-shaped configuration suitable for the entrance of the section of cable (1) and for retaining said section of cable (1) therein.

The drawing shows an enlargement of the building block (2), and the arrow shows the direction for moving said block closer to the lower part of one of the sections of cable (1) according to direction Y.

Figure 2B:
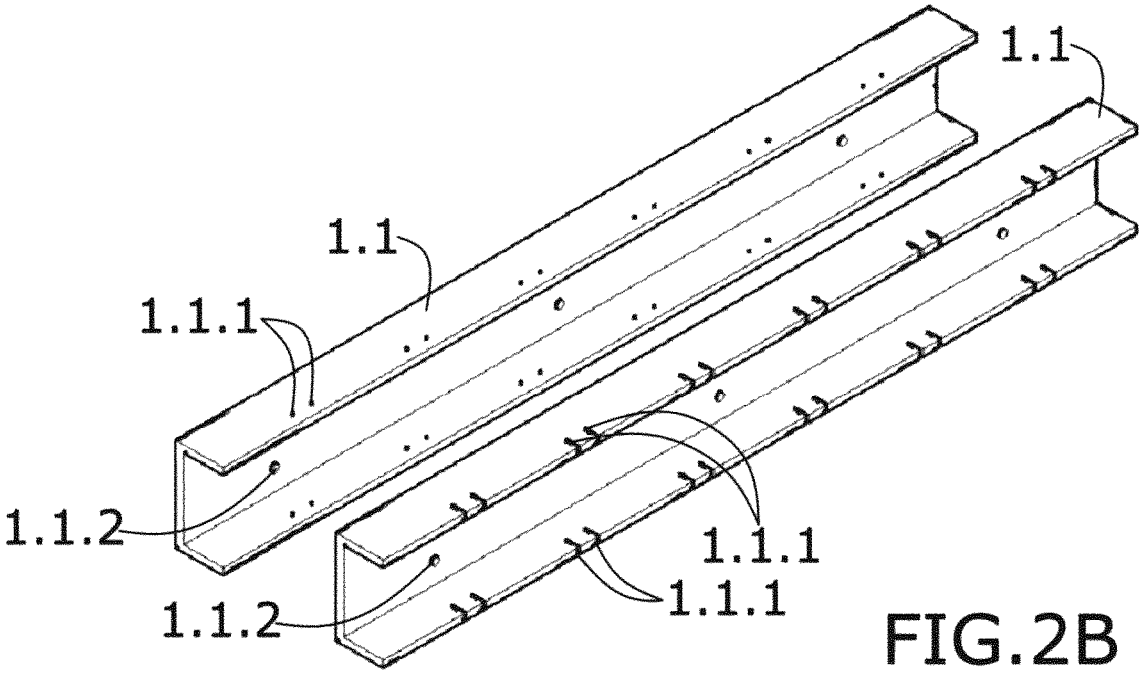

FIG. 2B shows another profile with two parallel flanges, where both parallel flanges comprise perforations or slots (1.1.1).

FIGS. 3A-D show perspective views of profiles (1.1) like those shown in FIGS. 2A-2B, spaced from one another and with the sections of cables (1) positioned between both profiles. The lower profile (1.1) will be fixed to a lower bearing member (P) and the upper profile (1.1) will be fixed to an upper bearing member (T). Not all the perforations or slots (1.1.1) that are available have to be used. Use will depend on the type of building block (2) used. One and the same profile (1.1) can have a valid configuration for several configurations of building blocks (2).

Figure 3A:
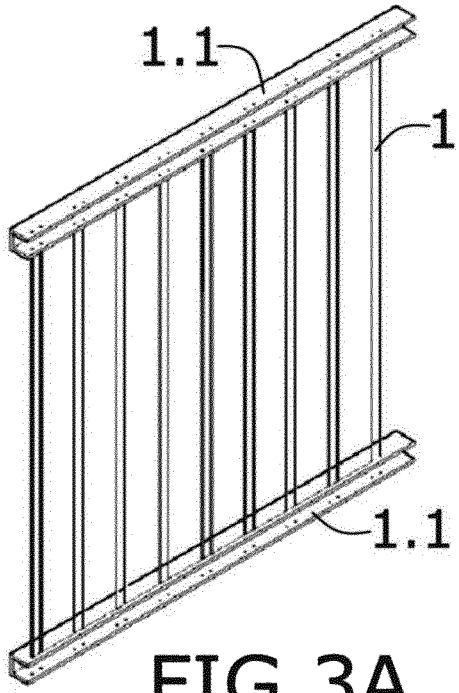
FIGS. 3A-3D These figures show the use of embodiments of anchoring parts like those shown in FIGS. 2A and 2B with the sections of cable installed and under stress.
Figure 3B:
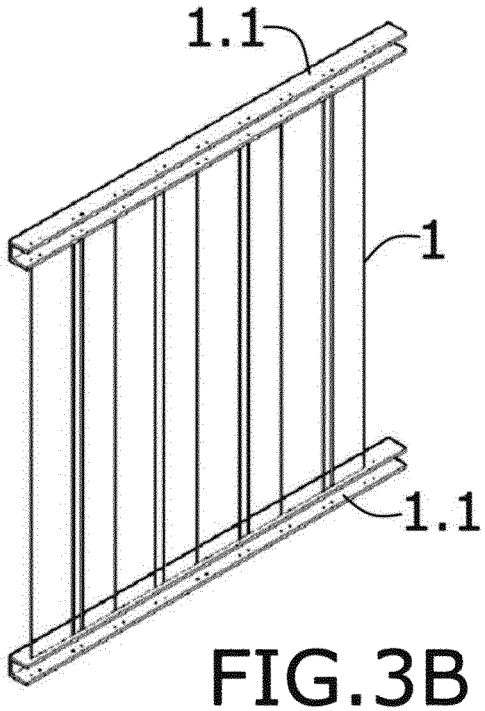
Figure 3C:
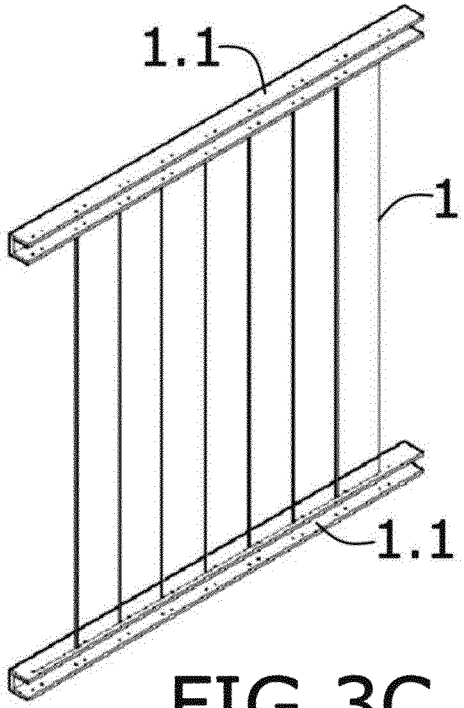
Figure 3D:
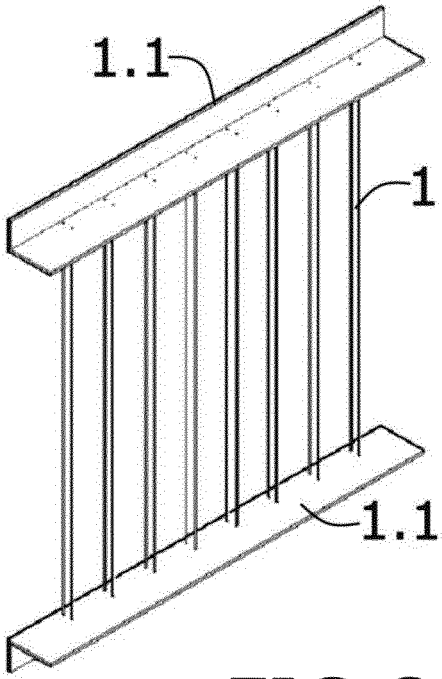
Figure 30:
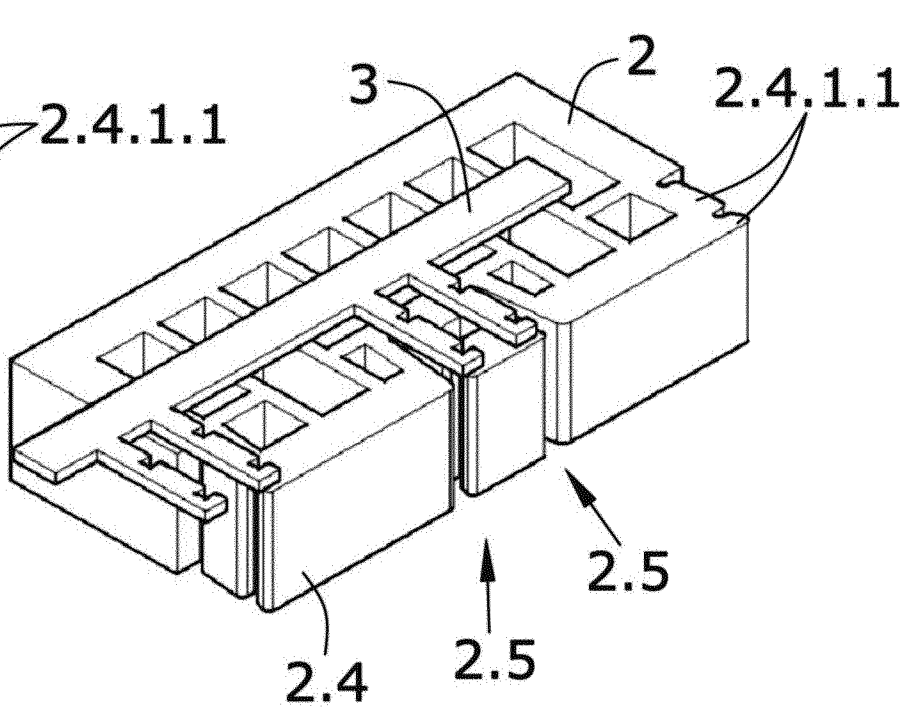
FIG. 30 This figure shows the same building block as in the preceding example as well as a spacing element adapted for maintaining the separation between pairs of sections of cable, for serving as a gap spacer and for acting as permanent formwork for subsequent filling with mortar, insulation and other materials.
Figure 29:
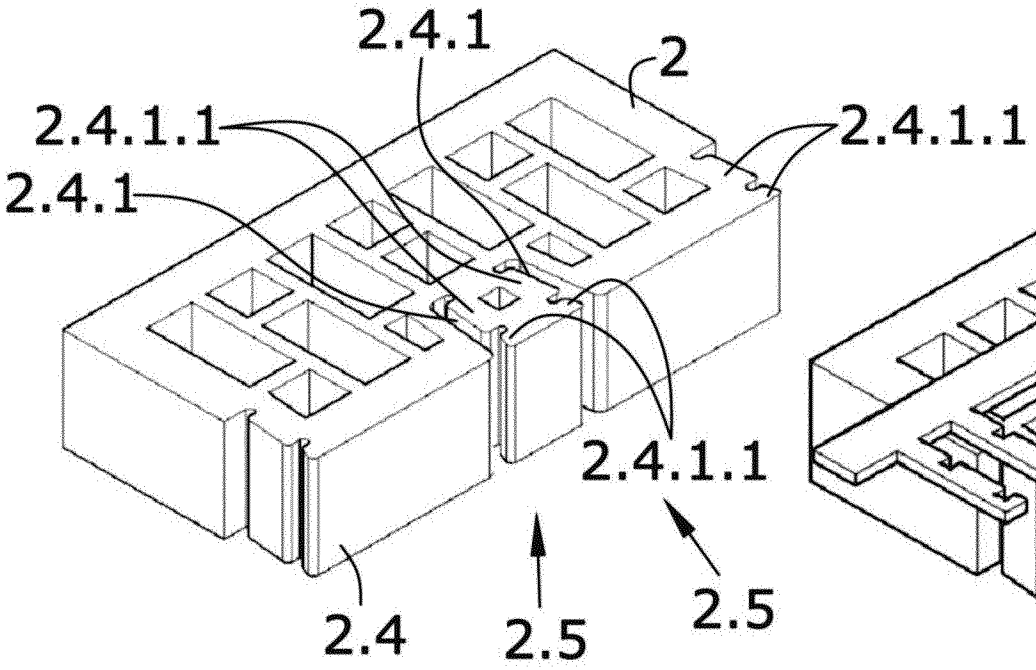
FIG. 29 This figure shows another embodiment where the anchoring means allow two sections of cables per recess.

FIG. 3D shows an embodiment in which there are two sections of cable (1) in one and the same position according to the directrix path (∫), which is straight in this case. This configuration increases stability of the wall that is built and is suitable for building blocks (2) having anchoring means (2.5) suitable for two sections of cable (1) simultaneously. Examples of building blocks (2) allowing two sections of cable (1) will be described below when FIGS. 29 and 30 are described.

Figure 4:
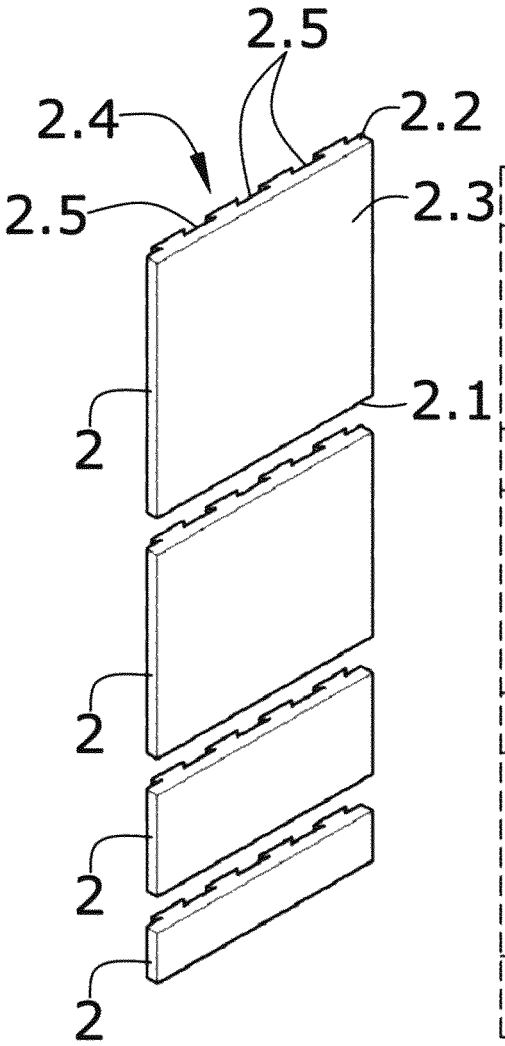
FIG. 4 This figure shows four examples of building blocks configured as tiles where the separation between the exposed surface and the anchoring surface is very small. The different examples show different heights of the tile.

FIG. 4 shows a particular configuration of a building block (2) configured as a tile. The drawing shows tiles of different heights. The exposed face (2.3) is smooth, and the first (2.1) and second (2.2) bases are very narrow because the distance between the exposed face (2.3) and the anchoring surface (2.4) is narrow compared with the remaining dimensions of the building block (2).

The anchoring surface (2.4) has a configuration incorporating dovetail-shaped recesses (2.4.1). These dovetail-shaped recesses (2.4.1) are recesses having two protuberances (2.4.1.1) opposite one another according to the orientation of the side faces in an oblique plane oriented towards the inside of said recess (2.4.1). The dovetail or half-dovetail configuration is an alternative for the anchoring means (2.5).

Figure 6:
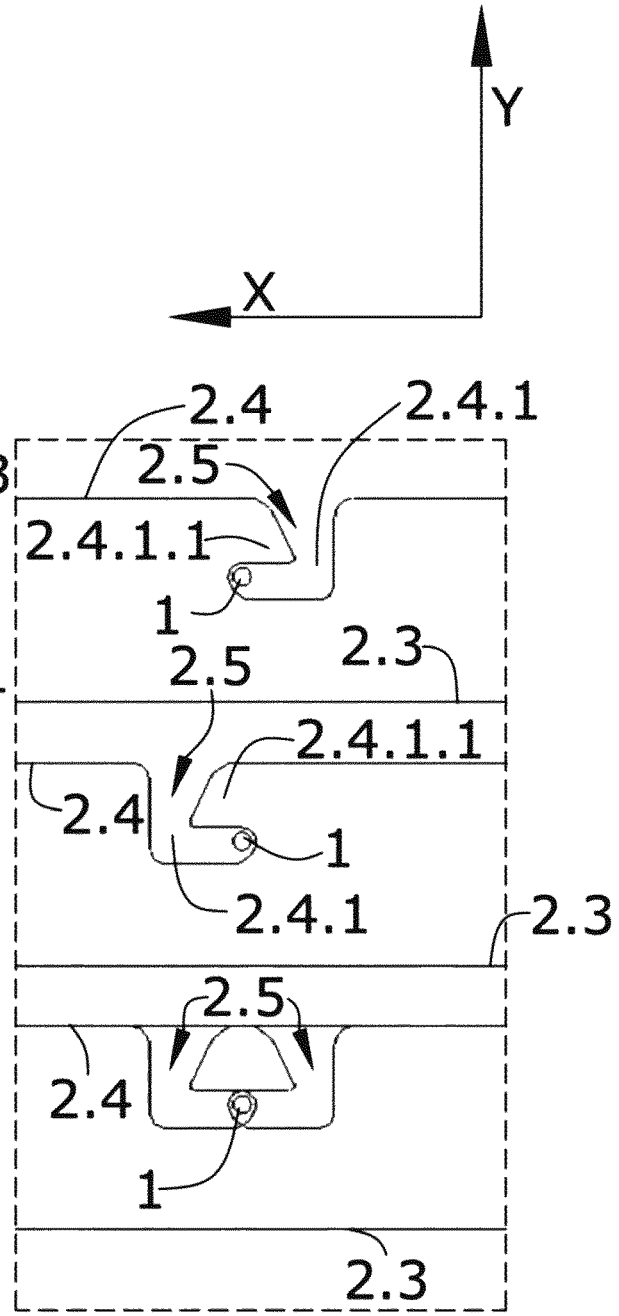
FIG. 6 This figure shows the same sequence but with the area of one of the cables enlarged.
Figure 5:
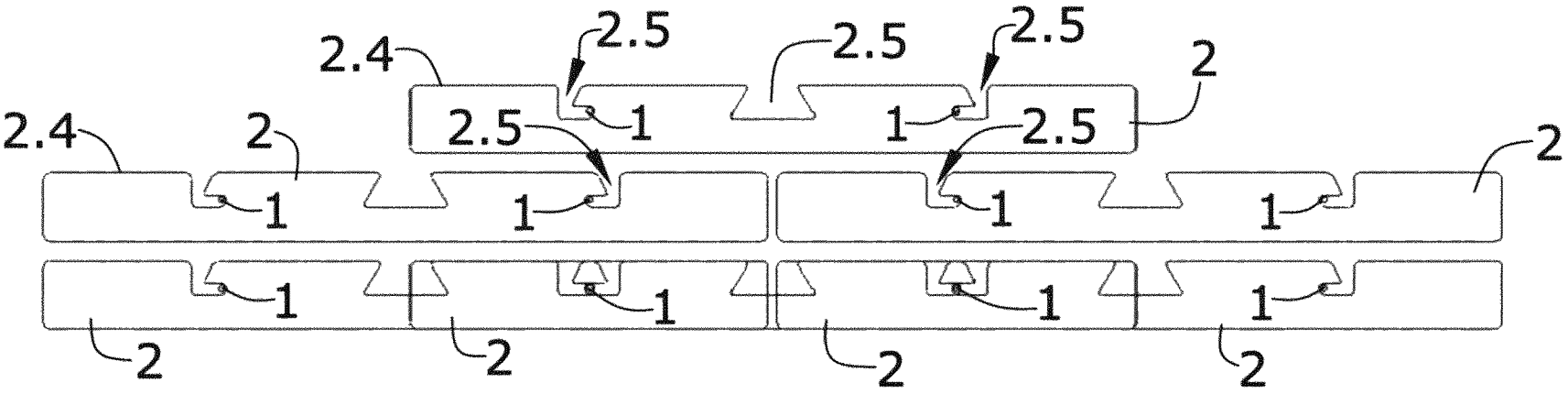
FIG. 5 This figure shows a plan view, from top to bottom, according to the orientation of the page, of a sequence of a) a building block with the sections of cable introduced in the anchoring means; b) two adjacent building blocks with the sections of cable introduced like; and c) the two previous blocks with a third superimposed block to show how the superimposition blocks lateral movement of the section of cable, stabilizing the construction.

FIGS. 5 and 6 show another alternative configuration of the recess (2.4.1) and protuberance (2.4.1.1) intended for preventing the section of cable (1) from coming out. FIG. 6 shows direction X and transverse direction Y with respect to the block (2) with the understanding that the building block (2) will be positioned and oriented following the direction that is tangential to the directrix path (∫), and therefore such directions can be taken to be directions with respect to the building block (2).

FIG. 5 shows a sequence of three graphical depictions arranged from top to bottom. The first graphical depiction shows a building block (2) where the alternative configuration for the recess (2.4.1.1) and protuberance (2.4.1.1) intended for preventing the section of cable (1) from coming out is configured according to an L-shape.

The second row shows two consecutive blocks (2) with sections of cable (1) positioned in the anchoring means (2.5), i.e., at the end of the L-shaped recess (2.4.1).

The third row in FIG. 5 shows the same row of blocks (2) superimposing another building block (2) in a staggered pattern. In other words, the third building block (2) is supported in two adjacent halves of a block (2) located thereunder.

Each building block (2) has two L-shaped recesses (2.4.1) although the L-shaped configuration of each recess (2.4.1) is in opposition, i.e., they have a symmetrical configuration.

By superimposing a building block (2) in a staggered pattern, the section of cable (1) is housed in a recess (2.4.1) with the L shape oriented towards one side according to direction X and it is housed in another recess (2.4.1) with the L shape oriented towards the opposite side according to the same direction X, in recess (2.4.1) of the building block (2) arranged thereabove.

The enlargement shown in FIG. 6 allows seeing that the opposing orientations of both L-shaped recesses (2.4.1) trap the section of cable (1) as shown in the vertical projection Z or in plan view.

Figure 7:
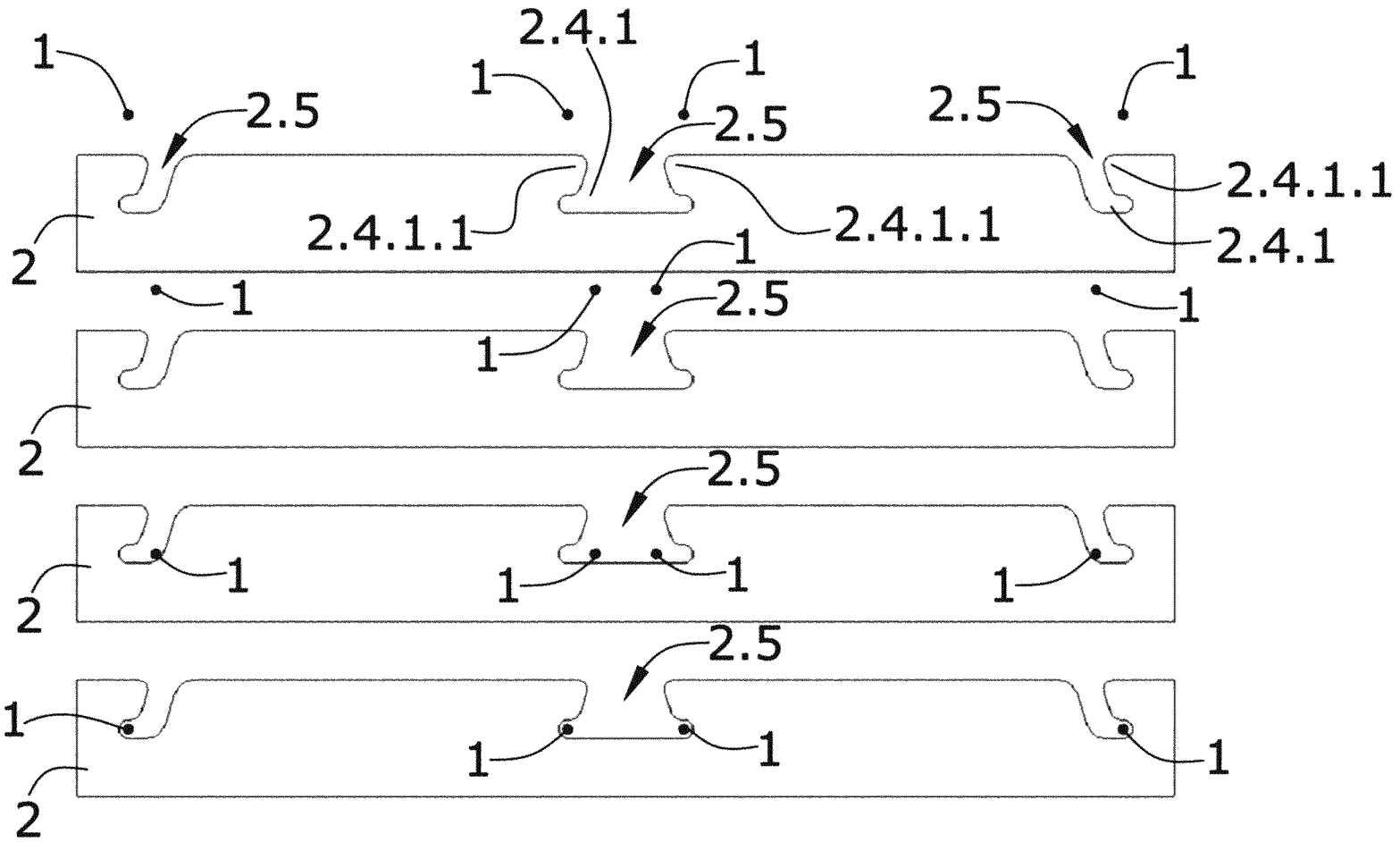
FIG. 7 This figure shows a plan view, from top to bottom, according to the orientation of the page, of a sequence for insertion of sections of cable in another example of tile-type building block with a very stable configuration of the anchoring means.

FIG. 7 shows another example of a building block (2) with two L-shaped recesses (2.4.1) opposite one another close to the side ends with respect to the view used in said FIG. 7, but with the orientation opposite the orientation shown in FIGS. 5 and 6. It additionally has a central recess (2.4.1) having two protuberances (2.4.1.1) opposite one another giving rise to a T-shaped recess. This configuration allows keeping the building block (2) secured by sections of cable (1) without needing the blocks (2) arranged adjacent to one another to laterally cooperate.

FIG. 7 shows a sequence, from top to bottom, of the entrance of sections of cable (1) in the recesses (2.4.1). The entrance of sections of cable (1) requires forcing the position of each section of cable (1) so that the building block (2) is positioned correctly on the wall and the sections of cable (1) are suitably housed at the end of each recess (2.4.1) behind the protuberance (2.4.1.1).

By way of example, two sections of cable (1) housed in the same central recess (2.4.1) are brought closer to one another by means of clamping. Although the sections of cable (1) are under stress, when the section of cable (1) is long lateral movement thereof is possible to allow the entrance of such building blocks (2) where there are protuberances opposite one another.

As construction of the wall progresses, the length of free sections of cable (1) between the last building block (2) and the upper end is increasingly shorter and it is more difficult to force lateral movement. One way to help in this deformation is by means of using tools which enhance the force applied on the section of cable, such as pliers.

Figure 8B:
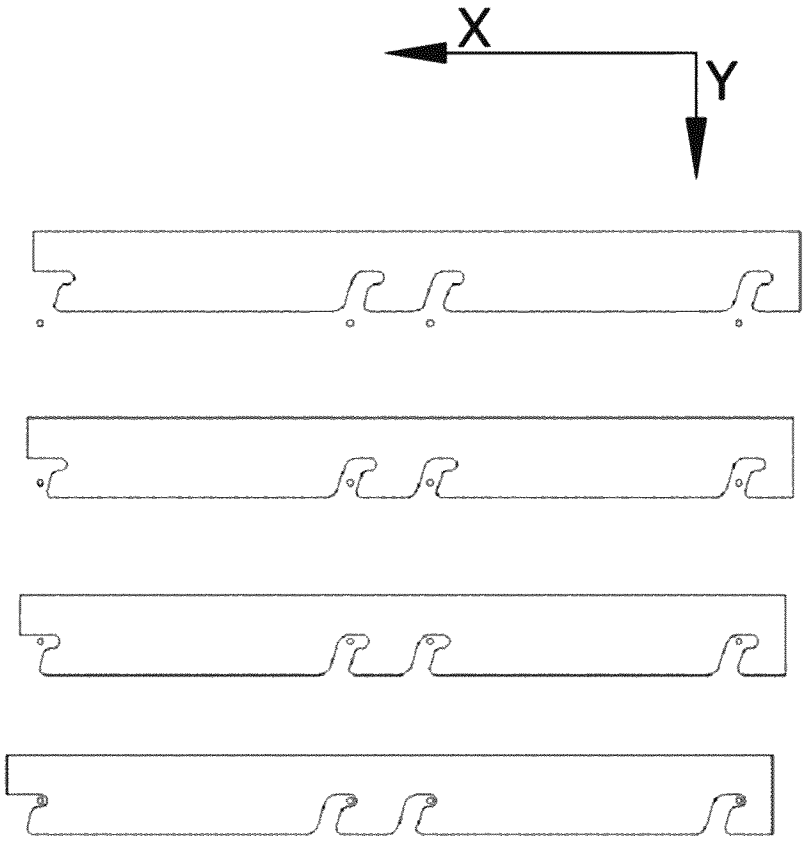
FIGS. 8A, 8B FIG. 8A shows two different perspective views of the configuration of a tile-type building block.
Figure 8A:
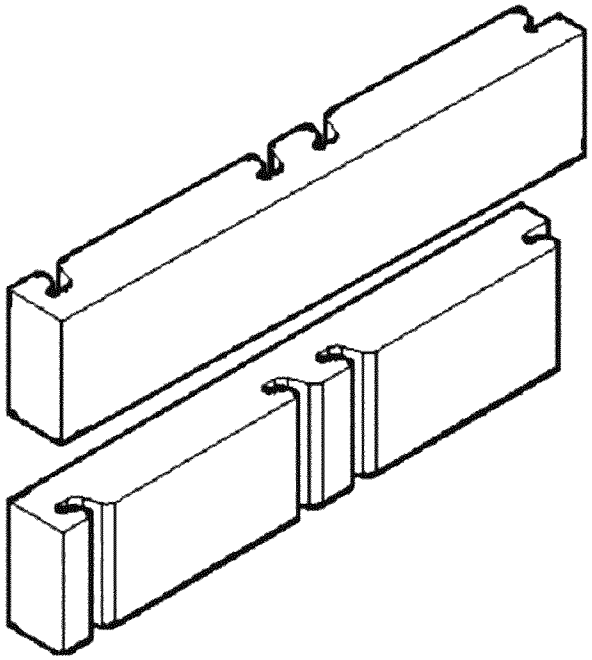

Even with these tools, for the last rows of section of cable (1) it may not be enough to obtain sufficient deformation. FIGS. 8A and 8B show a configuration of a building block (2) which can be used in these last rows.

In the configuration shown in FIGS. 8A and 8B, the protuberances of each of the recesses (2.4.1) are oriented in the same direction according to direction X.

The sequence for the entrance of the sections of cable (1) in the building block (2) with this configuration is shown in FIG. 8B from top to bottom. In the first two images the building block (2) is brought closer to the sections of cable (1) with a movement according to direction Y until such sections of cable (1) have completely entered the cavity. In this position, the building block (2) is moved laterally according to direction X until the sections of cable (1) are located behind the protuberance (2.4.1.1), assuring retention.

This second lateral movement imposes an order in the construction of the wall. If, for example, building blocks (2) are being incorporated according to the positive direction X. The configuration of each "L" must be such that the following building block (2) will have to be inserted according to the transverse direction Y, slightly shifted according to the positive direction X (separated from the building block (2) that is already placed in the wall), and the second movement is according to the negative direction X to secure the building block (2) in the sections of cable (1) by means of the protuberances (2.4.1.1). This operation is possible for all building blocks (2) of the row except the last one, which will require a smaller block at the end corresponding to the positive direction X and an additional filler part if the gap that is left is to be covered.

This reasoning must be changed to the opposite direction if the orientation of the L-shaped recesses (2.4.1) is the opposite.

This configuration of building block (2) allows ending the construction of the wall in the final rows thereof if the upper bearing member (T) is to be reached.

Figure 9A:
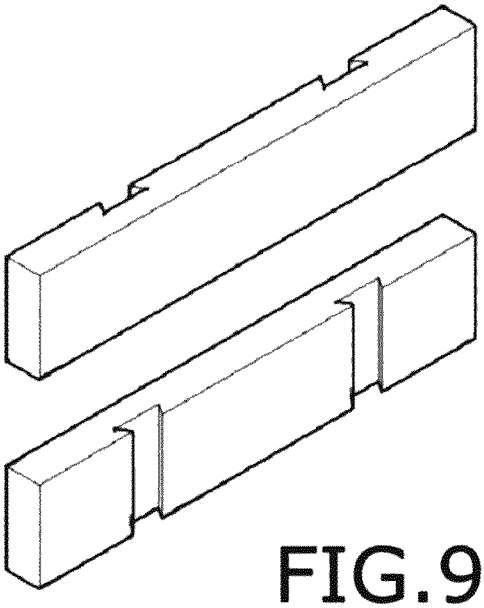
FIGS. 9A, 9B FIG. 9A shows two different perspective views of the configuration of a tile-type building block having a horizontal configuration or a configuration narrow in height.
Figure 9B:
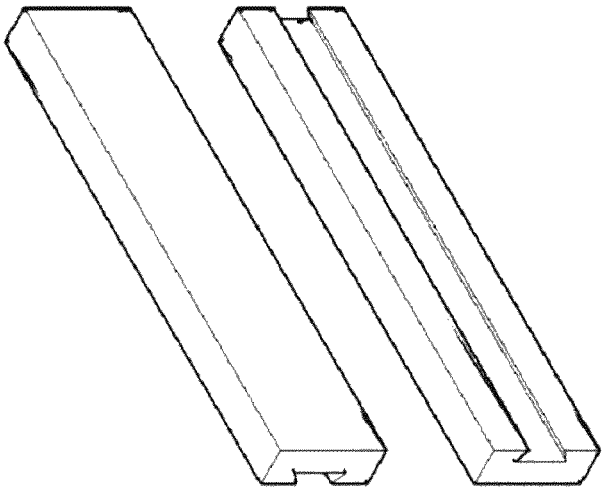

FIGS. 9A and 9B show perspective views of two embodiments of building blocks (2) with recesses (2.4.1) having two dovetail-shaped protuberances (2.4.1.1) opposite one another. FIG. 9A corresponds to a building block (2) having a horizontal configuration once placed in the wall, and FIG. 9B corresponds to a building block (2) having a vertical configuration.

Figure 10A:
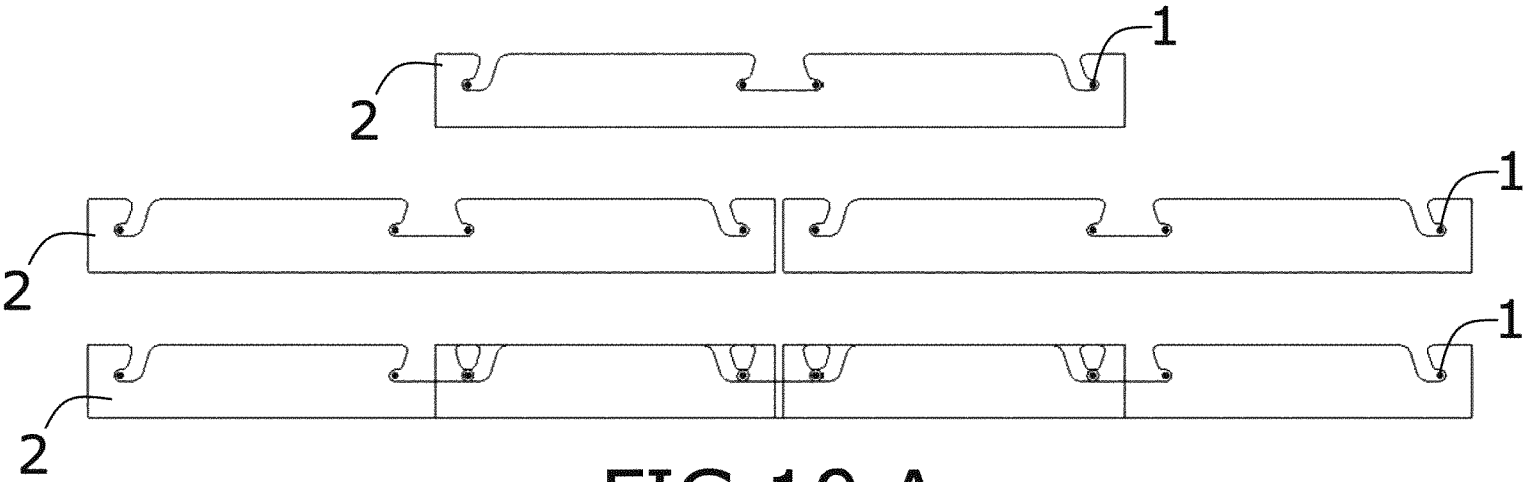
FIGS. 10A, 11A FIG. 10A shows a sequence like that shown in FIG. 5 using another example of a configuration for a tile-type building block.
Figure 11B:
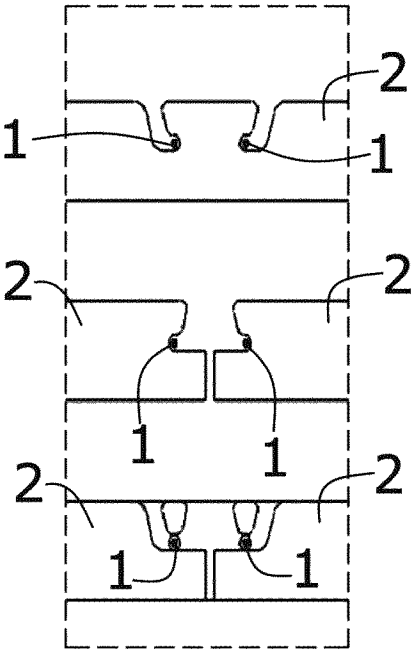
Figure 11A:
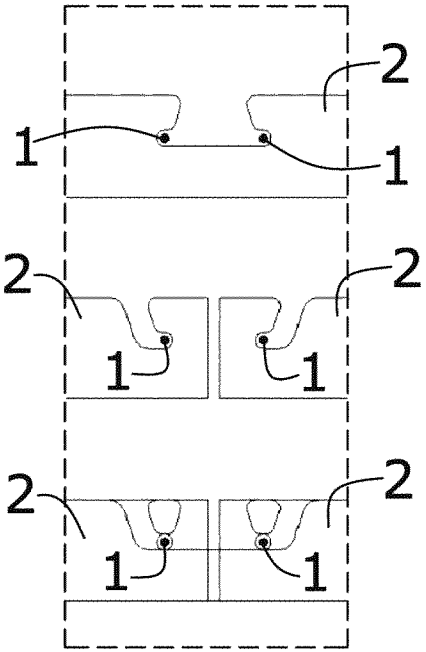

The same reasoning followed in the sequence of FIGS. 5 and 6 for showing how sections of cable (1) are being trapped by stacking in a staggered pattern is valid for the sequence of FIGS. 10A and 11A, where this sequence uses a building block (2) like the one shown in FIG. 7. The advantage of this building block is that each building block (2) has a section of cable (1) blocked at the end thereof, resulting in a very stable wall.

Figure 12A:
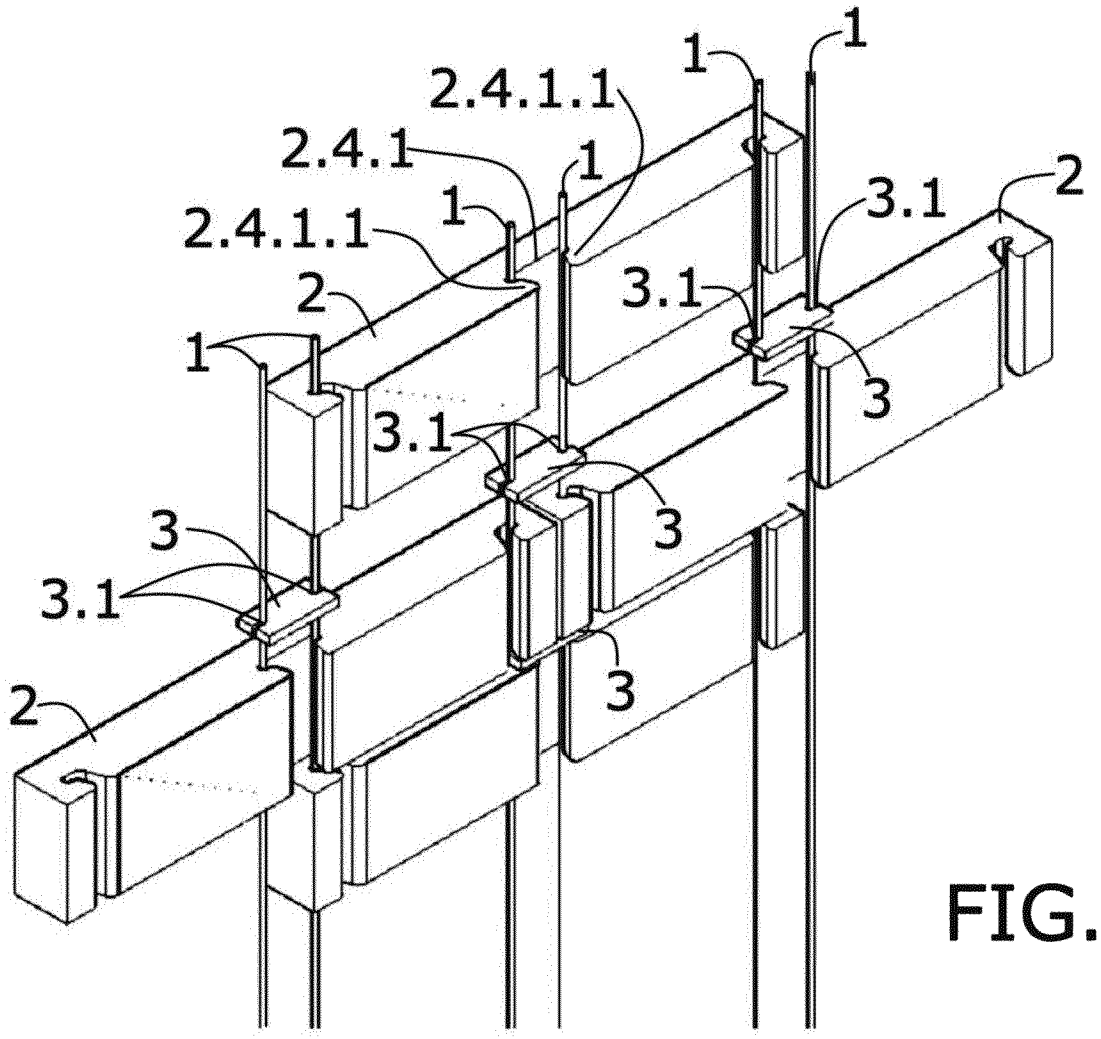
FIG. 12A, 12B These figures show perspective views of building blocks of three different rows corresponding to the examples shown in FIGS. 10A, 11A, 10B and 11B, respectively, including spacers defining a pre-established gap.

FIG. 12A shows a perspective view of a portion of wall with the upper building block (2) being slightly raised. This figure shows the use of spacing elements (3) adapted for being located between two sections of cable (1) where in the operative mode such sections of cable (1) are supported opposite one another in the at least one recess (2.4.1). The spacer (3) is shown in further detail in FIG. 20.

Figure 10B:
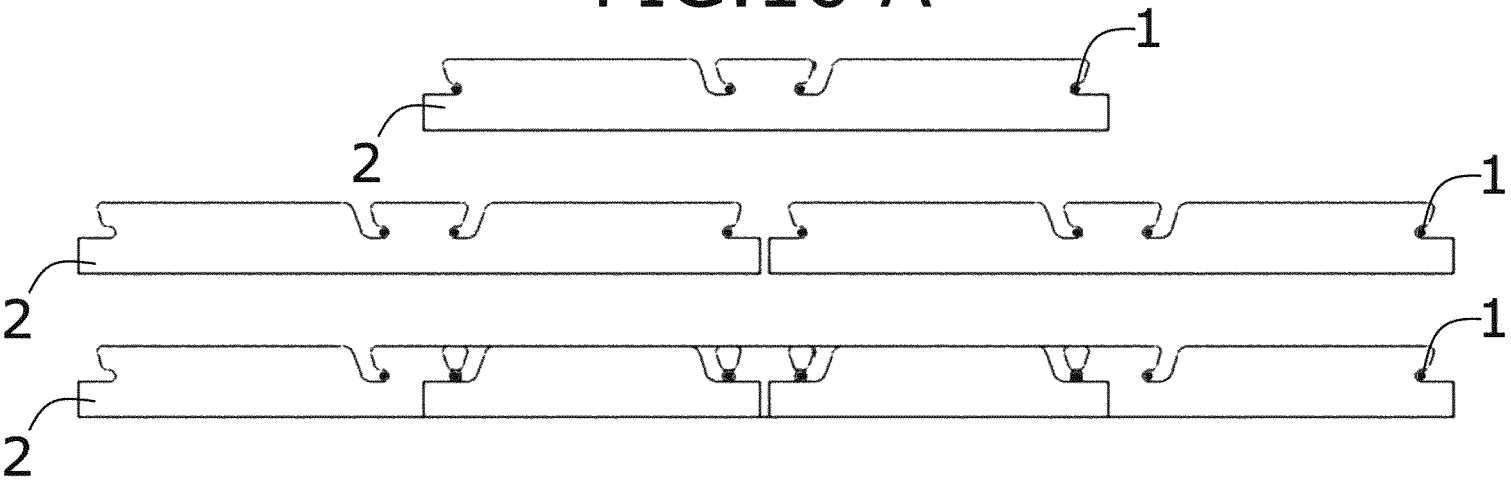
FIGS. 10B, 11B FIG. 10B shows a sequence like the one shown in FIG. 10A using another example of a configuration for a tile-type building block in which the recesses are oriented in the opposite direction and there are recesses at the ends of each part.
Figure 12B:
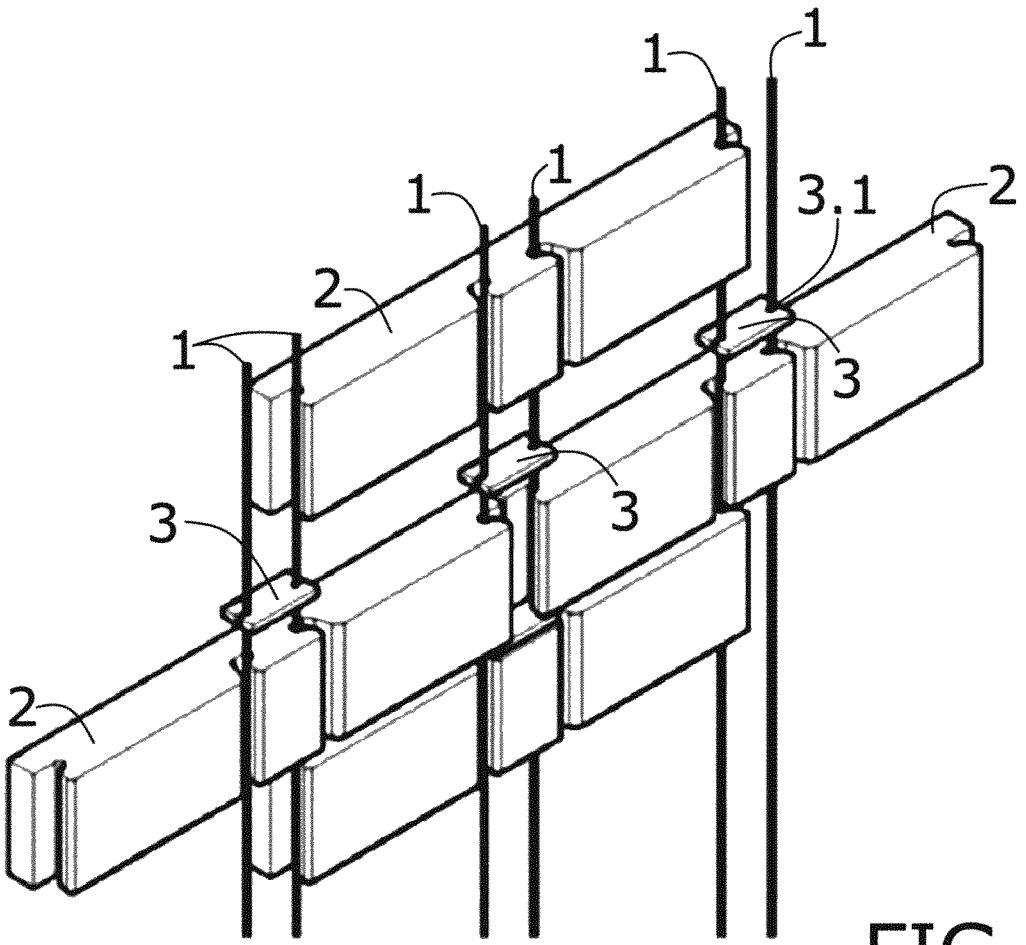

FIGS. 10B and 11B reproduce another example where the configuration of the building blocks (2) has L-shaped recesses (2.4.1) oriented in the opposite direction according to direction X. The result is the same, primarily when there is a stack comprising two or more rows, as shown in the detail of FIG. 11B and in the perspective view of FIG. 12B, given that from one row to the row immediately thereabove or therebelow, the orientation direction of the recess (2.4.1) is the opposite and the cable (1) also remains trapped.

In this embodiment, the spacing elements (3) are formed by a part in the form of a plate with two end grooves (3.1) opposite one another.

One groove (3.1) receives a section of cable (1) and the opposite groove receives another section of cable (1). This spacer (3) prevents the linking sections of cable (1) from moving closer to one another. In the case of the central recess (2.4.1) of the building block (2), this limitation means that it is not possible for the sections of cable (1) to come out of their housing.

Additionally, these spacers (3) also involve a gap or separation between rows of consecutive blocks. This gap allows the passage of air between blocks, favoring ventilation. Other configurations of spacers (3) cover the entire free space resulting from the gap or separation such that the gap is shown covered.

Figure 13:
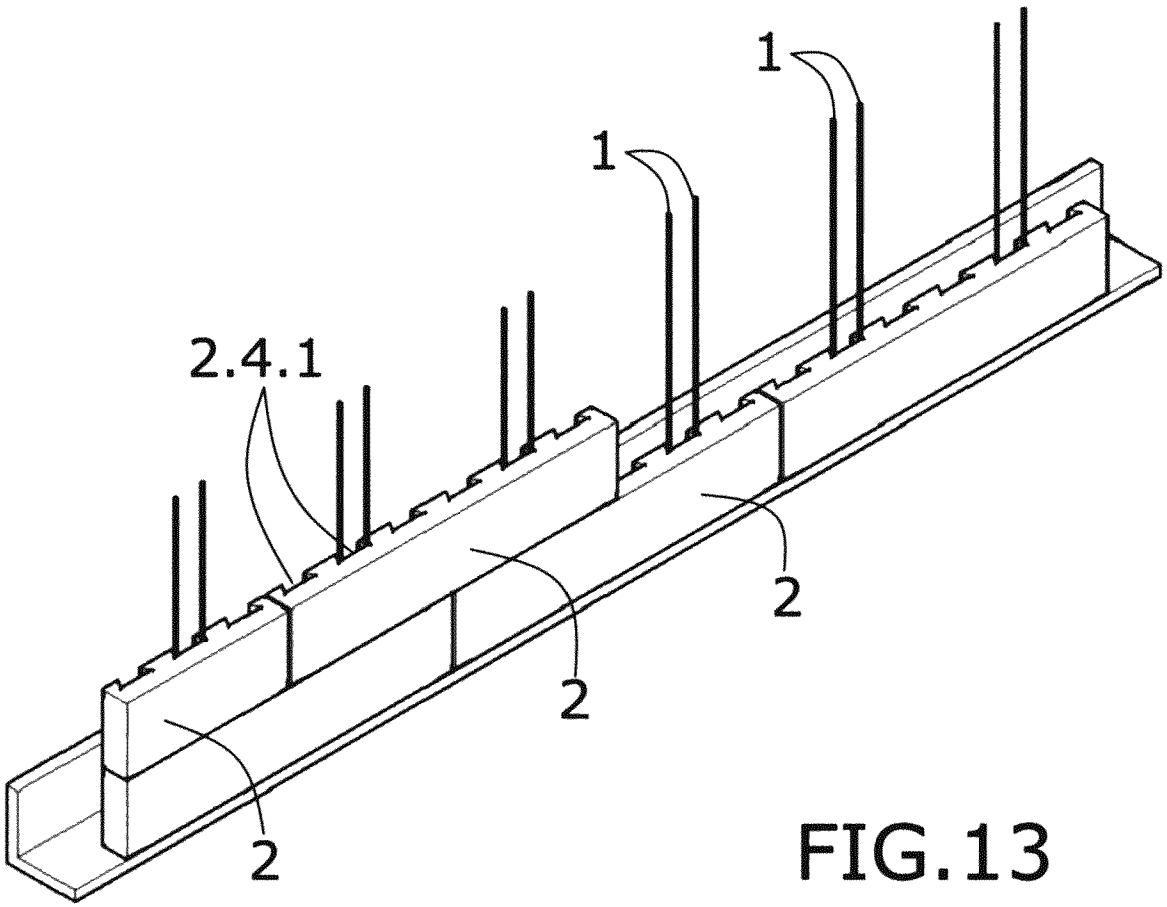
FIG. 13 This figure shows a perspective view of a lower fixing part with the sections of cable departing upwardly from same, as well as building blocks according to another embodiment forming the first and second row.

FIG. 13 shows an embodiment of the invention where the building blocks (2) are configured with multiple dovetail-shaped recesses (2.4.1) that allow choosing different positions for the building blocks (2) with respect to the sections of cable (1).

Figure 14:
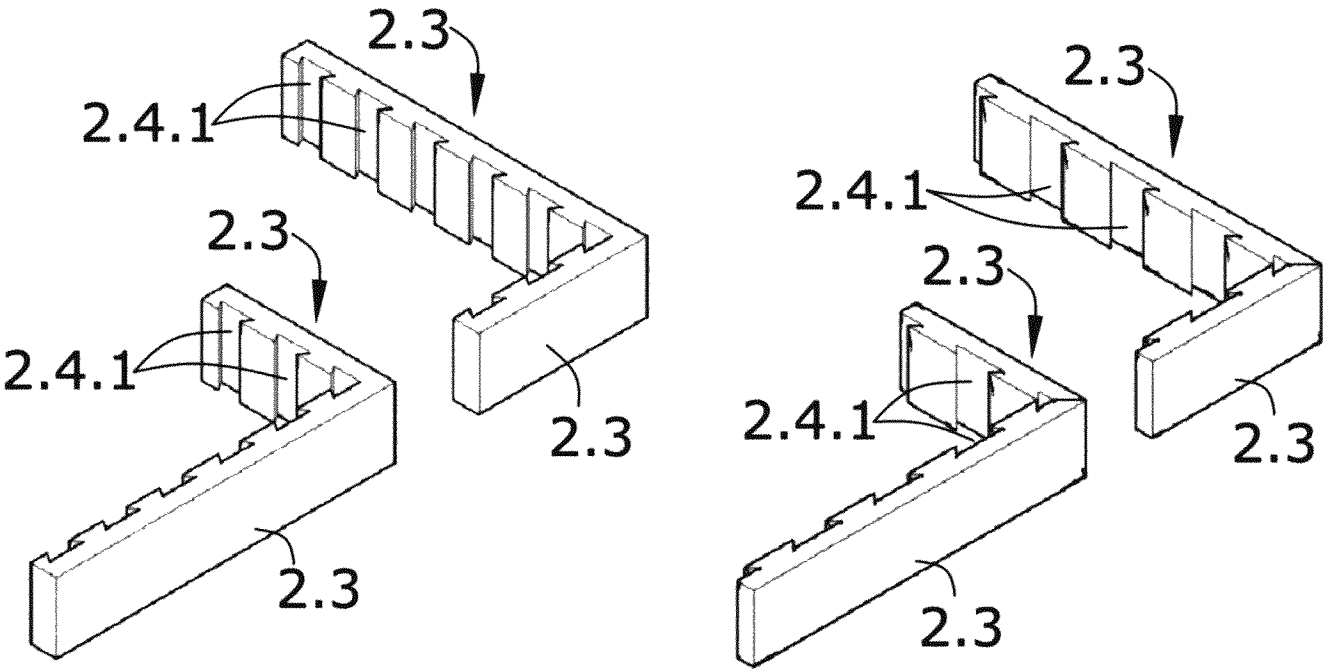
FIG. 14 This figure shows various examples of parts that allow finishing the corner where two wall planes converge according to an embodiment of the invention.

FIG. 14 shows embodiments of building blocks (2) that are formed by two sections, each of them having an exposed surface (2.3) and an anchoring surface (2.4) for handling corners. In these embodiments, dovetail-shaped recesses (2.4.1) are on two inner faces and result in two exposed surfaces (2.3), one per plane of the wall converging in the corner.

Figure 15:
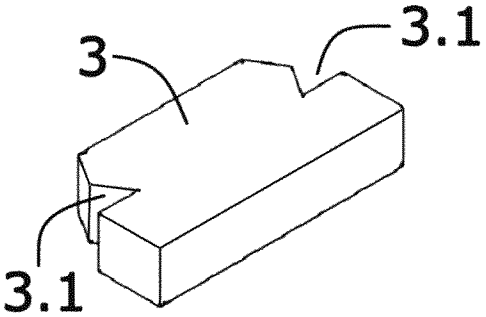
FIG. 15 This figure shows a retaining element that can be housed in a recess of the building blocks to secure the position of the section of cable without it coming out of said recess.

FIG. 15 shows a spacing element (3) particularly configured for being inserted between cables.

According to other embodiments of the invention, a spacer (3) with a configuration that does not generate a gap in the construction of the wall because it is housed in the recess (2.4.1) of the block (2) where said cables (1) pass is used to maintain the separation between cables (1).

Figure 16:
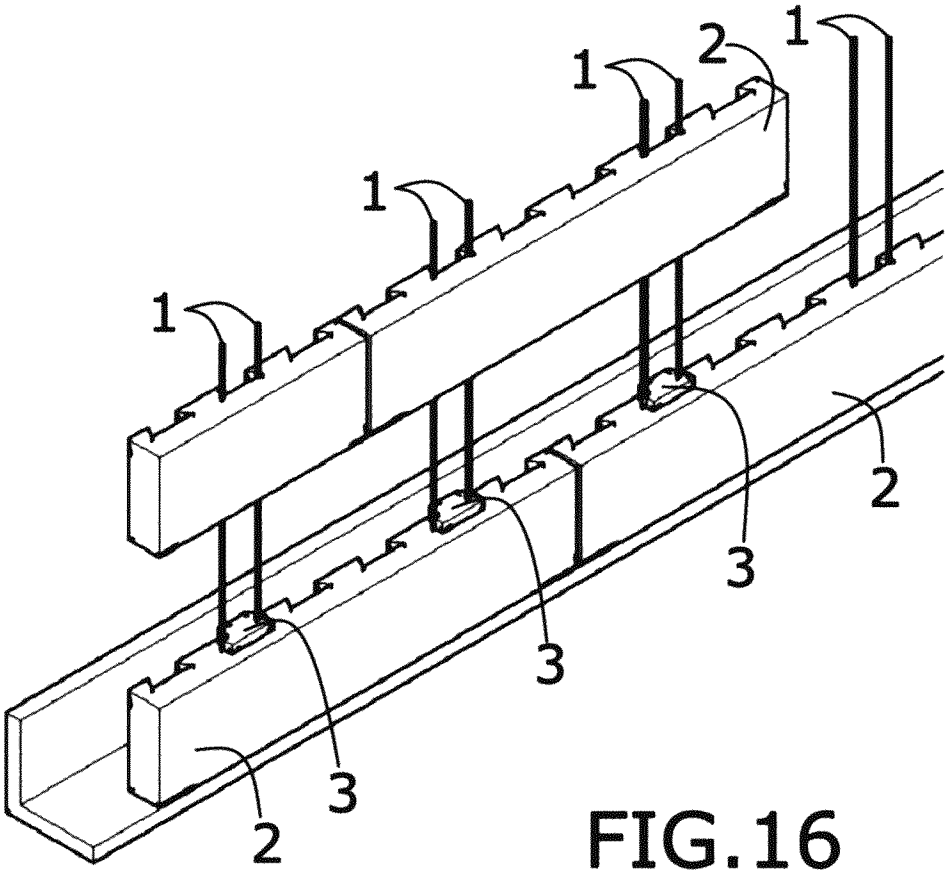
FIG. 16 This figure shows a perspective view equivalent to the perspective view of FIG. 13 where the sections of cable are secured with a part like that shown in the preceding drawing.

FIG. 16 shows the use of this spacing element (3) on a construction formed by a row of building blocks (2) with dovetail-shaped recesses (2.4.1) and also shows a second row of building blocks (2) that are slightly raised to allow seeing insertion of the spacing element (3).

Once the building block (2) is placed with the sections of cable (1) housed in the recess (2.4.1), the spacing element (3) is placed spacing out sections of cable (1) because they are located in the notches or grooves (3.1).

Figure 17:
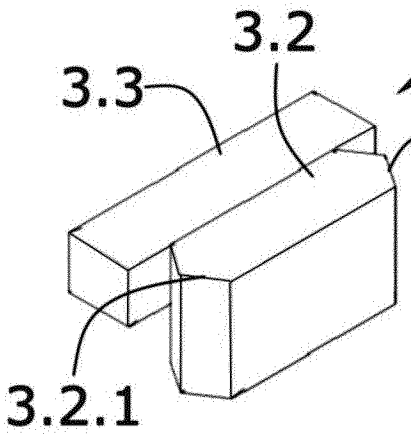
FIG. 17 This figure shows a perspective view of a spacing part also incorporating a portion that can be housed in the recess for maintaining the separation between sections of cable.

FIG. 17 shows an embodiment of a spacer (3) having two bodies attached to one another, a first body (3.2) intended for being housed in a dovetail-shaped recess (2.4.1) and a second body (3.3) spacing out two rows of blocks, giving rise to a gap or vertical separation.

The first body (3.2) has two bevels (3.2.1) used for leaving the space to which the passage of the section of cable (1) is limited such that it is confined in a position coinciding with the inner corner of the dovetail-shaped recess (2.4.1). The function of the spacer (3) is thereby obtained.

Figure 18:
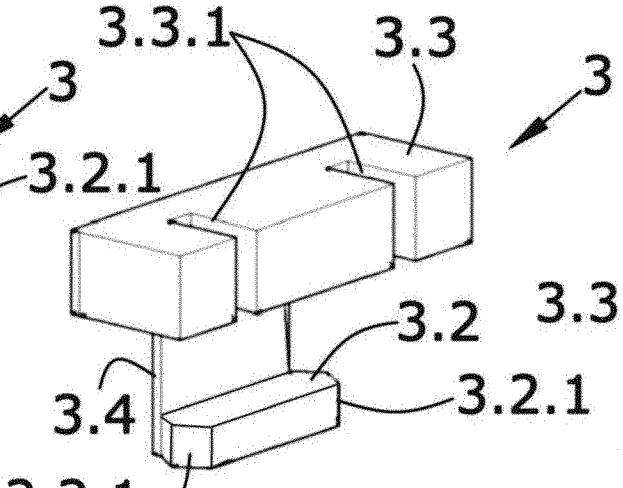
FIG. 18 This figure shows another embodiment different from that shown in the preceding drawing.

FIG. 18 shows another embodiment of a spacer (3) similar to the preceding embodiment, but the first body (3.2) and the second body (3.3) are vertically spaced from one another by a stripped plate (3.4). This configuration allows the first body (3.2) to be inserted in the recess (2.4.1) up to a greater depth and allows the second body (3.3) to have a larger area for supporting the building block (2) located above it. Given this larger area, the second body (3.3) is slotted (3.3.1) to allow the passage of the sections of cable (1).

Figure 19:
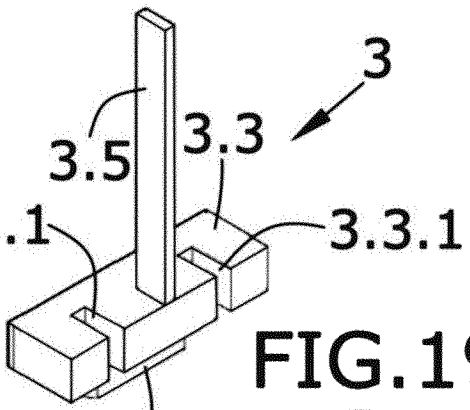
FIG. 19 This figure shows another embodiment different from that shown in the preceding drawing furthermore incorporating a vertical spacer for generating vertical gaps between consecutively arranged building blocks.

FIG. 19 shows another example of spacer (3) where a vertical stripped plate (3.5) serving as a separation between two building blocks (2) arranged consecutively in one and the same row emerges from the upper surface of the second body (3.3). This separation allows there to be a vertical gap, and furthermore it allows this gap to be filled with the material of the spacer.

Figure 20:
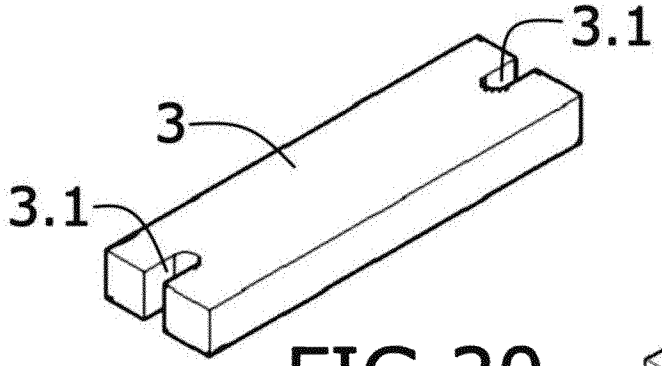
FIG. 20 This figure shows a perspective view of another embodiment of the spacer keeping two consecutive sections of cable spaced from one another.

FIG. 20 shows the simple spacer (3) described in FIG. 12A in an enlarged view.

Figure 21:
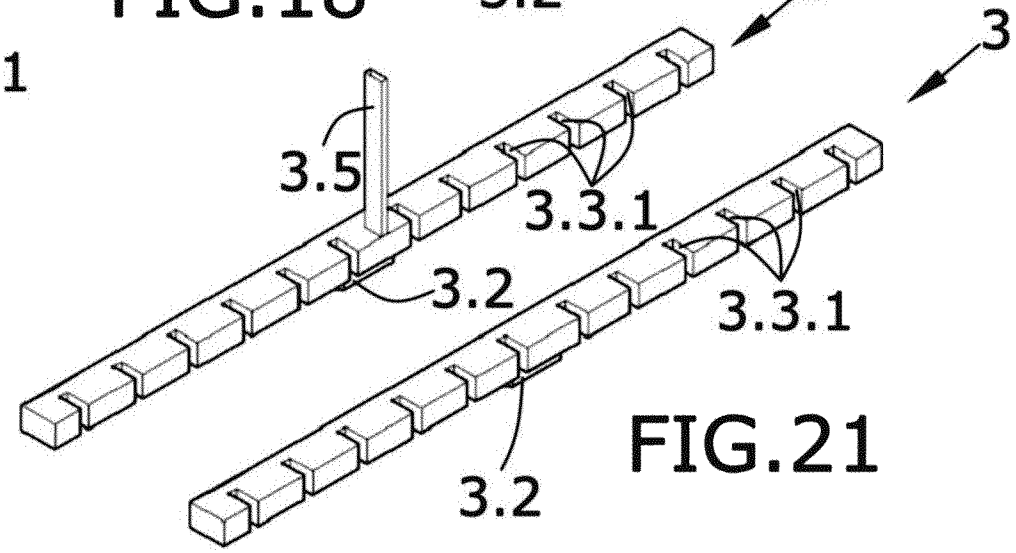
FIG. 21 This figure shows a perspective view of other embodiments of the spacer keeping a plurality of sections of cable covering the horizontal gap between rows of building blocks spaced from one another. One embodiment includes a vertical spacer between building blocks.

FIG. 21 shows a spacer (3) having a very elongated second body (3.3) for allowing passage of multiple sections of cable (1) through its grooves (3.3.1). This spacer allows filling extensive horizontal gap sections as shown in FIG. 22.

Figure 22:
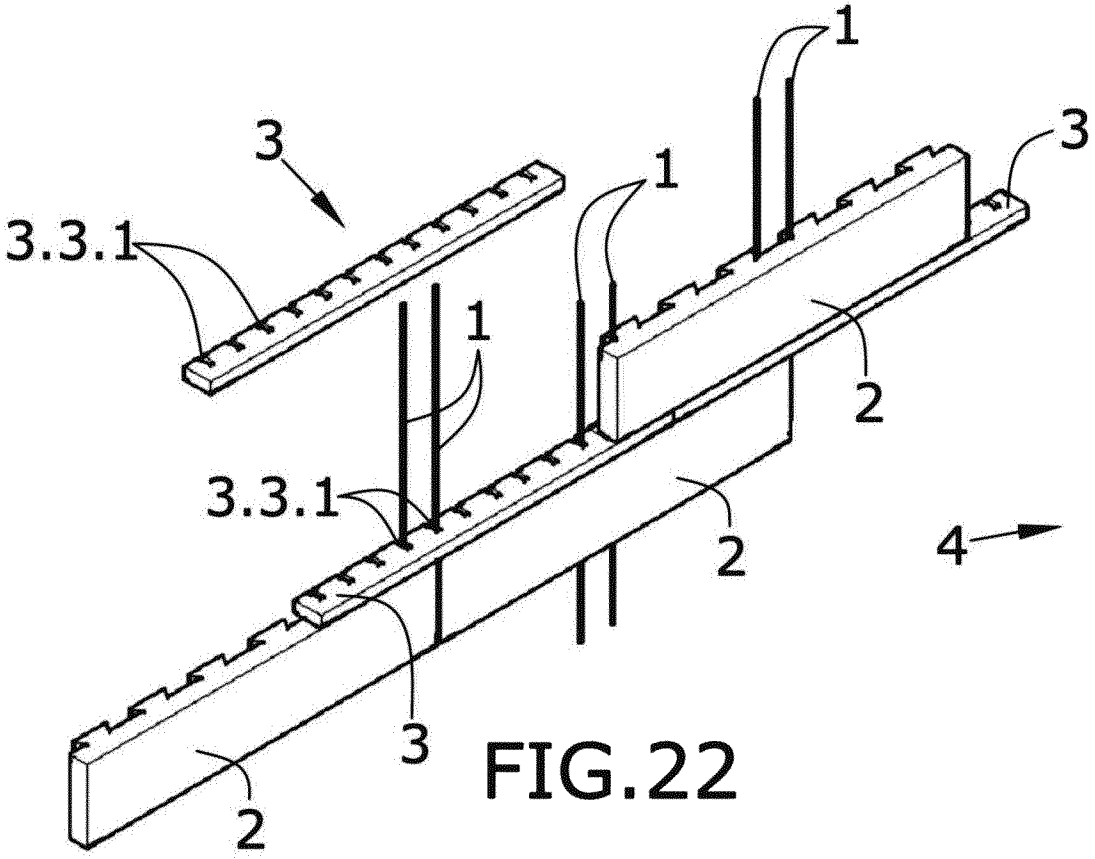
FIG. 22 This figure shows a perspective view of the use of an embodiment of the spacer for sections of cable when it is arranged between consecutive rows of building blocks.

Said FIG. 22 shows how the use of these spacers (3) with the second body (3.3) having a length equal to the width of a building block (2) or having the width of several building blocks (2) allows the generated horizontal gap to be filled with the material of the spacer (3). The spacer (3) can be manufactured from materials such as injected plastic, which allows using various colors, giving rise to high-quality finishes.

Figure 23:
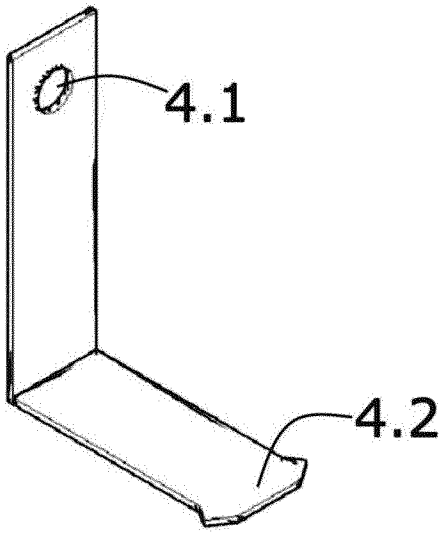
FIG. 23 This figure shows a retaining anchor for establishing a structural link between the wall according to an embodiment of the invention and a structure such as a wall spaced from the former.

FIG. 23 shows a retaining anchor (4). The retaining anchor (4) comprises:

fixing means (4.1) for fixing to a fixed structure, fixing means (4.2) configured for being housed or being retained in a recess (2.4.1) of the building block (2), and the retaining anchor (4) allows stabilizing the wall at one or more points with respect to the fixed structure.

According to the embodiment shown in this FIG. 23, the retaining anchor (4) is formed by a die cut and bent metal stripped plate. The vertical section has a perforation that allows fixing (4.1) to a fixed structure. If the wall according to the invention is for example a coating wall, the fixed structure is the wall being covered.

The fixing means (4.2) configured for being housed in a recess (2.4.1) of the building block (2) are in this case a widened section with the dovetail shape of a recess (2.4.1) where the corners are beveled to allow the passage of sections of cable (1) performing the function of a spacer (3).

Figure 24:
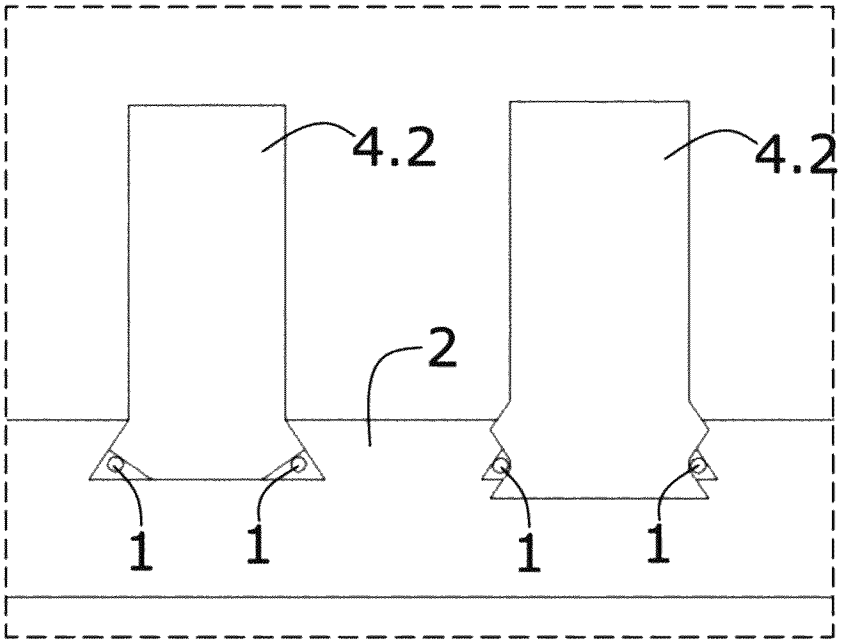
FIG. 24 This figure shows a plan view of two examples of fixing means for fixing a retaining anchor when it is already housed in the recess of the building block.

This function of spacer is shown in plan view in FIG. 24 in the example on the left. The width and shape of the fixing means (4.2) are such that the retaining anchor (4) enters the recess (2.4.1) and the bevels leave space for sections of cable (1).

In the embodiment on the right, the fixing means (4.2) are wider than the recess (2.4.1), such that the section of horizontal stripped plate of the retaining anchor (4) is trapped and retained between two or more building blocks (2) stacked on one another, whether or not they are vertically aligned, because the widening makes that it will not be housed in the recess (2.4.1), and it will only be retained in its position in plan view.

Figure 25:
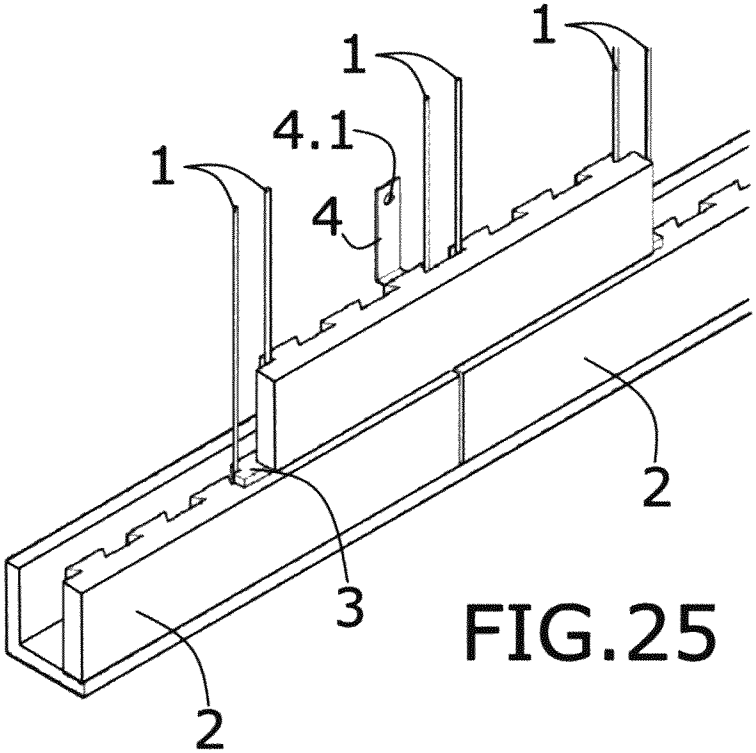
FIG. 25 This figure shows a perspective view of the construction of the two first rows of a wall according to an embodiment of the invention showing a retaining anchor in the rear part.

FIG. 25 shows an embodiment of a wall with three building blocks (2), once they are placed in the sections of cable (1), and with part of the retaining anchor (4) oriented towards the non-exposed part of the wall arranged for having its fixing means (4.1) for fixing to a fixed structure parallel to and supported on the wall to be covered (not shown in the drawing for the sake of clarity).

Figure 26:
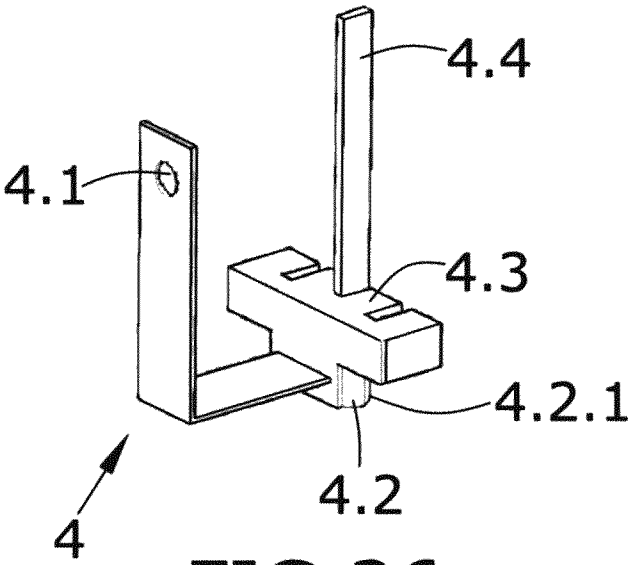
FIG. 26 This figure shows an embodiment of a retaining anchor the fixing means of which further comprising elements working as spacers configured for being housed in a recess.

FIG. 26 shows an anchor (4) the fixing means (4.2) of which are an element having a complementary configuration of the recess (2.4.1) in which it is intended for being housed, except bevels (4.2.1) allowing the passage of sections of cables (1), on which there is a planar body (4.3) to give rise to the horizontal gap, and on the latter there is a vertical stripped plate (4.4) for the vertical gap. This embodiment incorporates all the elements: horizontal gap, vertical gap, spacer and retaining anchor.

Figure 27:
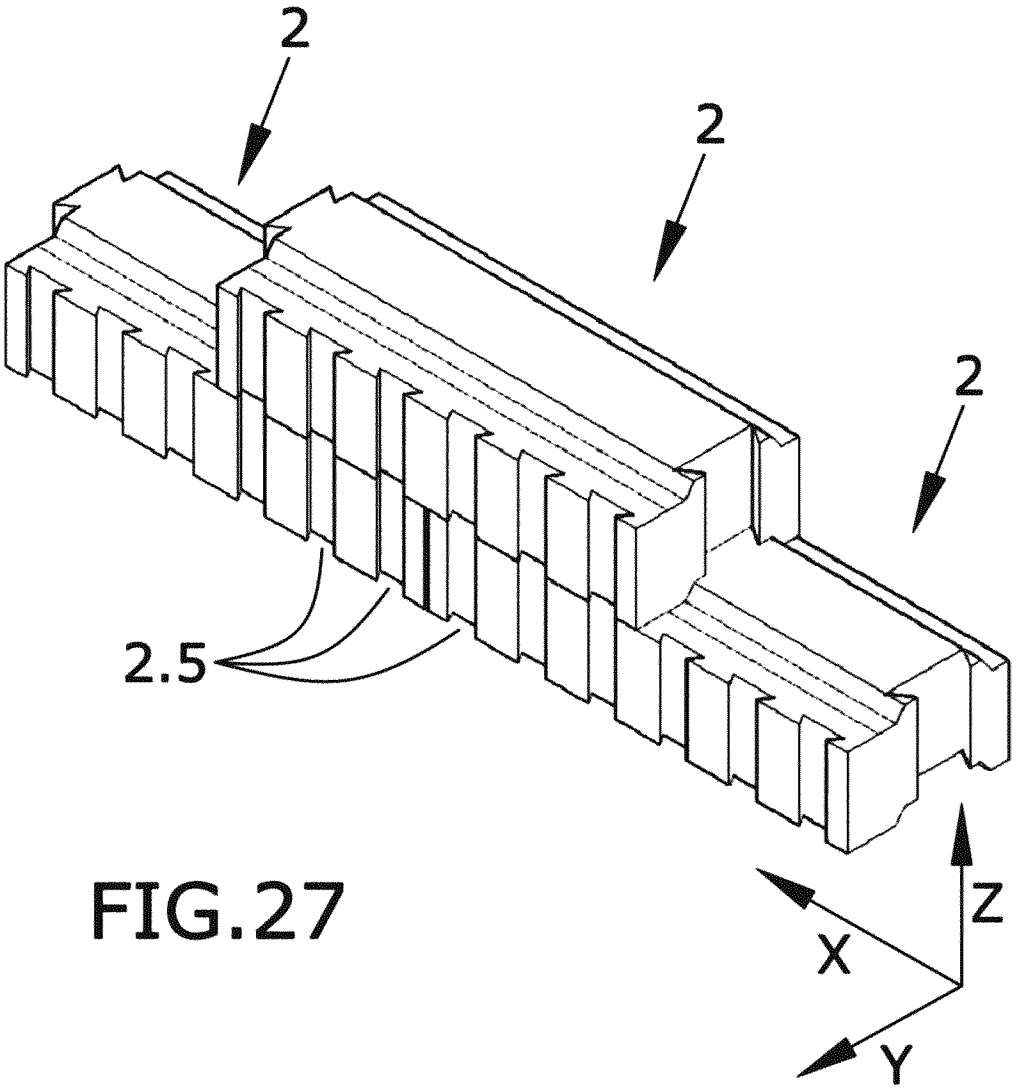
FIG. 27 This figure shows the configuration of a building block having in its bases a recess and a longitudinal protrusion arranged for allowing coupling in stacking, improving stability of the wall that is built and with a dovetail coupling in the heads.

FIG. 27 shows an embodiment of a building block (2) which, unlike the tile that is widely used in the preceding examples, has greater width. The first support base (2.1) has a longitudinal protuberance according to the direction X which is complementary to a longitudinal channel arranged in the second base (2.2). These complementary shapes mean that there is retention between rows of building blocks (2) according to the transverse direction Y with respect to the wall, and stability of the construction is greater.

The perspective view selected in FIG. 27 allows seeing the anchoring surface (2.4) where the recesses (2.4.1) are dovetail-shaped. As occurs in other configurations of any of the preceding examples, this figure shows how the recesses (2.4.1) have a configuration such that when stacked, they give rise to a continuous vertical groove that allows sections of cable (1) to extend when they are housed in the plurality of recesses (2.4.1) through which they pass along the entire length thereof.

These building blocks (2) additionally incorporate a dovetail-shaped anchor on the faces intended for being adjacent with contiguous building blocks (2) of the same row.

Figure 28:
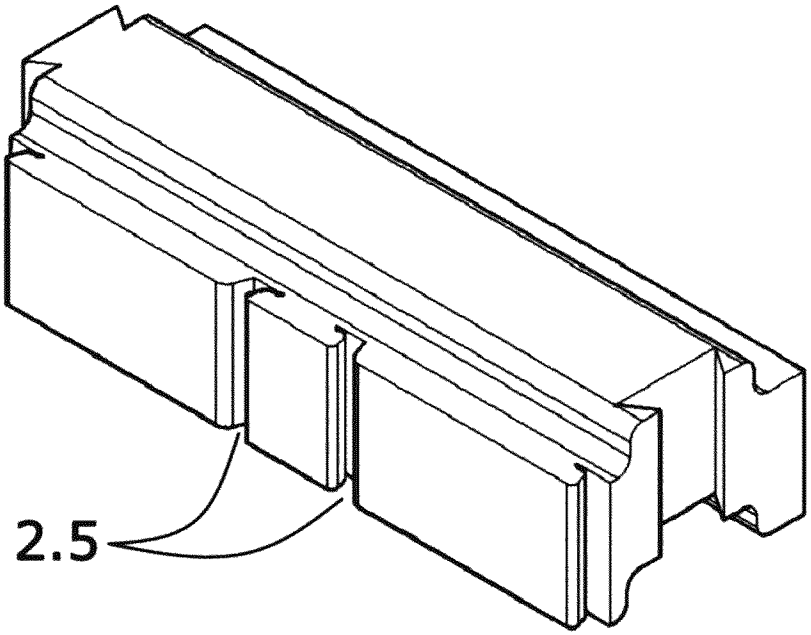
FIG. 28 This figure shows another embodiment of a building block, with the housings for confining the cables.

FIG. 28 shows another example of a building block (2) similar to the preceding example, where in this example the recesses (2.4.1) of the anchoring surface (2.4) have an L-shaped configuration.

As indicated above, FIG. 3D shows fixing means (1.1) fixing two sections of cable (1) for each position according to direction X, spaced from one another according to direction Y.

FIG. 29 shows a building block (2) suitable for this distribution of sections of cable (1) because the anchoring surface (2.4) has recesses (2.4.1) in which in each recess (2.4.1) there are two protuberances (2.4.1.1) at different depths which in turn give way to two housings for sections of cable (1).

FIG. 30 shows the same building block (2) with a spacer (3) in the stacking having two pairs of prolongations with successive recesses adapted for receiving pairs of sections of cable (1). The spacer (3) can therefore be positioned in the stack between building blocks (2), defining the horizontal gap, and establishing a reference with respect to the relative positioning of this spacer (3) and the building blocks (2) when stacked.

Optionally, both horizontal and vertical continuous spacers (3) can furthermore be used as permanent formwork if the possible space between the fixing wall to be covered and the wall according to the invention in any of its thicknesses can be filled with cement mortar, insulating mortar, expanded polyurethane or any other thermal and/or resistant insulating material that requires being confined. The spacers (3) establish a barrier that prevents the material filling in the space between the fixing wall to be covered and the wall according to the invention from coming out through the gaps generated by said spacers (3).

Although the main application of the invention is the formation of a wall intended for covering another fixing wall, according to other embodiments it is possible to have two walls according to the invention arranged parallel to and spaced out from one another.

According to another embodiment, between both walls there is one or more retaining anchors (4) which together strengthen walls arranged parallel to one another. When these walls that are spaced out from one another use spacers (3) forming gaps and a barrier between the space located on either side of the wall, they also allow filling with cement mortar, insulating mortar, expanded polyurethane or any other thermal and/or resistant insulating material that requires being confined.

The invention claimed is:

1. A constructive assembly for building walls covering a surface extending between a lower bearing member and an upper bearing member located above said lower bearing member, according to a direction of gravity (Z), where said assembly comprises:

a plurality of sections of flexible cable configured to laterally deform, each of the sections of flexible cable having ends with fixing means at the ends thereof adapted to be fixed tautly between the lower bearing member and the upper bearing member, distributed according to a directrix path in the lower bearing member and the upper bearing member, and a plurality of building blocks having a prismatic body where each building block comprises at least:

a first support base configured for resting on the lower bearing member or on at least another building block, a second base arranged on a face opposite the first base configured for supporting at least another building block, an exposed surface extending between the first base and second base, and an anchoring surface extending between the first base and second base arranged on the face opposite the exposed surface, wherein:

the anchoring surface of the building blocks comprises anchoring means for the anchoring thereof to the sections of flexible cable configured to laterally deform, for stabilizing the wall; and wherein the building block has:

a first horizontal direction (X) is established as a direction tangent to the directrix path, and a transverse direction (Y) is established as a second horizontal direction which is perpendicular to both the direction of gravity (Z) and a first horizontal direction (X); and, wherein the anchoring means of the anchoring surface are configured by means of a recess penetrating the anchoring surface, such that in a plan projection on a plane parallel to a plane formed by the first horizontal direction (X) and the transverse direction (Y), this recess additionally shows a protuberance projecting in the first horizontal direction (X), this protuberance being configured for retaining at least one section of flexible cable configured to laterally deform, according to the direction (Y).

2. The constructive assembly according to claim 1, wherein the recess and the protuberance configure in the plan projection at least one L-shaped cavity.

3. The constructive assembly according to claim 1, wherein the recess and the protuberance configure in the plan projection at least one half dovetail-shaped cavity.

4. The constructive assembly according to claim 1, wherein the building block comprises two protuberances arranged opposite one another, each being configured for retaining at least one section of flexible cable configured to laterally deform, when the building block is in an operative position in the wall.

5. The constructive assembly according to claim 1, wherein the anchoring means comprised in the anchoring surface of the building blocks are positioned at end positions and intermediate positions according to the first horizontal direction (X), such that the anchoring means of a building block located at end positions coincide with the anchoring means of at least another building block located at intermediate positions according to the vertical direction (Z) when the building blocks are operatively placed in the wall in a staggered pattern.

6. The constructive assembly according to claim 1, wherein said constructive assembly additionally comprises one or more spacers adapted for being located between two sections of flexible cable configured to laterally deform, where in an operative mode such sections of flexible cable configured to laterally deform are supported opposite one another in the at least one recess.

7. The constructive assembly according to claim 6, wherein the spacer or part of said spacer is configured for being housed:

in the recess of at least one of the building blocks, between at least two building blocks of two consecutive rows according to the direction of gravity (Z), between at least two consecutive building blocks according to the first horizontal direction (X), in one and the same row of the at least one of the building blocks, or in any combination thereof.

8. The constructive assembly according to claim 1, wherein said assembly additionally comprises a retaining anchor comprising:

first fixing means for fixing to a fixed structure, and second fixing means configured for being housed or being retained in a recess of the building block, to stabilize the wall at one or more points with respect to the fixed structure.

9. The constructive assembly according to claim 8, wherein the second fixing means of the retaining anchor configured for being housed in the at least one of the recesses of the building block are one or more spacers adapted for being located between two sections of flexible cable configured to laterally deform, where in an operative mode such sections of flexible cable configured to laterally deform are supported opposite one another in the at least one recess.

10. A construction comprising at least one wall comprised of the constructive assembly according to claim 1, wherein the wall covers the surface extending between the lower bearing member of the construction and the upper bearing member of the construction located above said lower bearing member, according to the direction of gravity (Z), where said assembly comprises:

the plurality of sections of flexible cable having ends with fixing means at the ends thereof fixed tautly between the lower bearing member and the upper bearing member, distributed according to the directrix path in the lower bearing member and the upper bearing member, and the plurality of building blocks distributed in rows, each of which following the directrix path, and where each of the building blocks has anchoring means anchored to one or more said sections of flexible cable.

11. The construction according to claim 10, wherein the lower bearing member and the upper bearing member additionally comprise a longitudinal bearing member where the fixing means for fixing the sections of flexible cable configured to laterally deform are attached such that said fixing means establishes the spatial distribution of the sections of flexible cable configured to laterally deform.

12. The construction according to claim 10, additionally comprising a retaining anchor and wherein said retaining anchor attaches the at least one wall to at least:

a second inner wall of the building, the façade of the building, a bearing structure of the building, or any combination thereof.

13. The construction according to claim 10, wherein the wall is spaced from a second wall such that between both walls there is:

an air space, an insulating material, resistant mortar, or any combination thereof.

* * * * *